US008515306B2

(12) United States Patent
Kawai et al.

(10) Patent No.: US 8,515,306 B2
(45) Date of Patent: Aug. 20, 2013

(54) CARTRIDGE AND IMAGE FORMING APPARATUS

(75) Inventors: Tachio Kawai, Odawara (JP); Tadashi Horikawa, Numazu (JP); Hiroshi Takarada, Gotemba (JP); Takashi Nakanishi, Abiko (JP)

(73) Assignee: Canon Kabushiki Kaisha, Toko (JP)

( * ) Notice: Subject to any disclaimer, the term of this patent is extended or adjusted under 35 U.S.C. 154(b) by 464 days.

(21) Appl. No.: 12/466,058

(22) Filed: May 14, 2009

(65) Prior Publication Data

US 2009/0290904 A1 Nov. 26, 2009

(30) Foreign Application Priority Data

May 23, 2008 (JP) ..... 2008-135683

(51) Int. Cl.
*G03G 21/16* (2006.01)

(52) U.S. Cl.
USPC ..... 399/111

(58) Field of Classification Search
USPC ..... 399/107, 108, 110–114, 119, 125
See application file for complete search history.

(56) References Cited

U.S. PATENT DOCUMENTS

| | | | | |
|---|---|---|---|---|
| 5,903,803 | A | 5/1999 | Kawai et al. | 399/116 |
| 6,055,406 | A | 4/2000 | Kawai et al. | 399/360 |
| 6,115,567 | A | 9/2000 | Kawai et al. | 399/106 |
| 6,128,454 | A | 10/2000 | Kawai et al. | 399/116 |
| 6,163,665 | A | 12/2000 | Watanabe et al. | 399/111 |
| 6,175,706 | B1 | 1/2001 | Watanabe et al. | 399/167 |
| 6,226,478 | B1 | 5/2001 | Watanabe et al. | 399/117 |
| 6,240,266 | B1 | 5/2001 | Watanabe et al. | 399/117 |
| 6,336,018 | B1 | 1/2002 | Kawai et al. | 399/117 |
| 6,381,430 | B1 | 4/2002 | Yokomori et al. | 399/119 |
| 6,385,416 | B1 | 5/2002 | Horikawa et al. | 399/111 |
| 6,453,136 | B1 | 9/2002 | Yasumaru | 399/111 |
| 6,463,232 | B1 | 10/2002 | Kawai et al. | 399/111 |
| 6,480,687 | B1 | 11/2002 | Kawai et al. | 399/111 |
| 6,496,667 | B2 | 12/2002 | Shiratori et al. | 399/103 |
| 6,501,926 | B1 | 12/2002 | Watanabe et al. | 399/117 |

(Continued)

FOREIGN PATENT DOCUMENTS

| | | |
|---|---|---|
| CN | 1435735 | 8/2003 |
| CN | 1444114 | 9/2003 |
| JP | 2005266781 | 9/2005 |
| JP | 2006-171407 | 6/2006 |

OTHER PUBLICATIONS

Office Action in Chinese Patent Application No. 201110152818.1, mailed Aug. 27, 2012 (with English translation).

*Primary Examiner* — Hoan Tran
(74) *Attorney, Agent, or Firm* — Fitzpatrick, Cella, Harper & Scinto

(57) ABSTRACT

A cartridge is detachably insertable into a main assembly of the image forming apparatus. The main assembly includes an opening, and urging, positioning, and regulating portions. The cartridge includes an urgable portion urged by the urging portion in a direction crossing a cartridge-inserting direction after cartridge insertion. The cartridge also includes a positionable portion positioned by contacting the positioning portion by the urging portion moving the cartridge in the crossing direction, and a regulatable portion regulated by the regulating portion to prevent cartridge movement toward the opening when the positionable portion contacts the positioning portion. The regulatable portion is at the cartridge rear and is brought, by cartridge movement in the crossing direction by the urging portion, behind the regulating portion with respect to the inserting direction to prevent cartridge movement toward the opening.

21 Claims, 15 Drawing Sheets

(56) References Cited

U.S. PATENT DOCUMENTS

| | | | | |
|---|---|---|---|---|
| 6,501,927 | B1 | 12/2002 | Watanabe et al. | 399/117 |
| 6,553,189 | B2 | 4/2003 | Miyamoto et al. | 399/27 |
| 6,560,422 | B2 | 5/2003 | Kanno et al. | 399/106 |
| 6,681,088 | B2 | 1/2004 | Kanno et al. | 399/111 |
| 6,735,403 | B2 | 5/2004 | Kanno et al. | 399/103 |
| 6,738,588 | B2 | 5/2004 | Yokomori et al. | 399/111 |
| 6,947,686 | B2 | 9/2005 | Kawai et al. | |
| 6,968,142 | B2 | 11/2005 | Arimitsu et al. | 399/114 |
| 7,006,776 | B2 * | 2/2006 | Matsuzaka et al. | 399/111 |
| 7,016,626 | B2 | 3/2006 | Yokomori et al. | 399/117 |
| 7,027,754 | B2 | 4/2006 | Harada et al. | 399/111 |
| 7,046,942 | B2 | 5/2006 | Arimitsu et al. | 399/114 |
| 7,085,516 | B2 | 8/2006 | Kawai et al. | |
| 7,116,925 | B2 | 10/2006 | Yamaguchi | |
| 7,130,560 | B2 | 10/2006 | Kawai et al. | 399/110 |
| 7,233,752 | B2 | 6/2007 | Harada et al. | 399/111 |
| 7,310,489 | B2 | 12/2007 | Kawai | 399/111 |
| 7,319,834 | B2 * | 1/2008 | Yamaguchi | 399/111 |
| 7,346,293 | B2 * | 3/2008 | Suzuki et al. | 399/111 |
| 7,366,440 | B2 | 4/2008 | Horikawa | 399/111 |
| 7,386,241 | B2 | 6/2008 | Mori et al. | 399/12 |
| 7,386,253 | B2 * | 6/2008 | Ishii et al. | 399/111 |
| 7,398,034 | B2 * | 7/2008 | Ito et al. | 399/111 |
| 7,415,224 | B2 * | 8/2008 | Hayakawa | 399/111 |
| 7,457,569 | B2 | 11/2008 | Kawai | 399/258 |
| 7,519,311 | B2 * | 4/2009 | Murakami et al. | 399/111 |
| 7,555,249 | B2 | 6/2009 | Kawai | 399/258 |
| 7,567,769 | B2 * | 7/2009 | Noguchi et al. | 399/110 |
| 2005/0047820 | A1 | 3/2005 | Hoshi et al. | |
| 2007/0223970 | A1 | 9/2007 | Kawai | |
| 2009/0080934 | A1 | 3/2009 | Nakanishi et al. | 399/111 |

* cited by examiner (a)

(b)

(c)

(a)

(b)

(c)

(a)

(b)

(c)

CARTRIDGE AND IMAGE FORMING APPARATUS

FIELD OF THE INVENTION AND RELATED ART

The present invention relates to a cartridge removably mountable in the main assembly of an image forming apparatus. It also relates to an image forming apparatus which employs a cartridge removably mountable in the main assembly of an image forming apparatus.

One of the examples of an image forming apparatus is an electrophotographic image forming apparatus, which is an apparatus for forming an image on recording medium with the use of an electrophotographic image forming process. These apparatuses include an electrophotographic copying machine, an electrophotographic printer (an LED printer, a laser beam printer, etc.), an electrophotographic facsimile apparatus, and an electrophotographic word processor, for example.

A recording medium is a medium on which an image is formed. As for examples of a recording medium, there are a recording sheet, an OHP sheet, etc.

A cartridge is a container, which is removably mountable in the main assembly of an image forming apparatus, and in which some of the substances, devices, etc., which are necessary for image formation, are placed. One of the examples of a cartridge is a process cartridge, in which an electrophotographic photosensitive member, and at least one among a charging means, a developing means, and a cleaning means, is integrally disposed.

In many cases where a combination of the main assembly of an image forming apparatus, and a cartridge (cartridges) for the image forming apparatus, are transported (in particular, commercially distributed) in a single box, the main assembly and the cartridge are separately wrapped, and then, are packed together in the single box for shipment. This arrangement requires a shipment box to be greater in size, making greater the shipment cost for the pair, than in a case where the main assembly of an image forming apparatus and the cartridge(s) therefor are packaged in a single shipment box. Further, it takes more time and effort for a user to take the pair out of the box and unwrap them after purchasing the image forming apparatus; it increases the amount of load to which the user is subjected before the user can actually use the product.

Thus, there has been devised an image forming apparatus, the door of the main assembly of which can be kept shut with a process cartridge (cartridges) mounted in its main assembly while it is transported (Japanese Laid-open Patent application 2006-171407). More specifically, this image forming apparatus is structured so that an elastic member can be placed between the main assembly and the process cartridge to prevent the problem that during the transportation of the image forming apparatus, the process cartridge in the main assembly is damaged because it shifts in position in the main assembly. Thus, this structural arrangement makes it possible to use a substantially smaller shipment box than the shipment box that has been used. In other words, this structural arrangement can improve the combination of an image forming apparatus and a cartridge therefor, in the efficiency with which they can be transported.

There has also been devised a color image forming apparatus, which is structured so that a process cartridge can be mounted into, or removed from, its main assembly in a direction parallel to the axial line of the photosensitive drum in the process cartridge, and the main assembly of which is provided with a door for covering or exposing the opening of the main assembly, through which a cartridge is to be mounted or removed (U.S. Pat. No. 6,453,136). In the case of image forming apparatuses such as this image forming apparatus, one end of the rotational axle of the photosensitive drum of a process cartridge is supported and positioned by the rear wall of the main assembly of an image forming apparatus, whereas the other end is supported and positioned by the door unit of the main assembly, which is at the front of the apparatus main assembly. Therefore, the process cartridge can be easily regulated in its position relative to the main assembly in terms of the direction in which it is mounted into the main assembly.

However, in the case of the above-described technology disclosed in the Japanese Laid-open Patent Application 2006-171407, the door is subjected to the reactive force which is generated by the elastic member, and which is equal in strength to the amount of the pressure applied to the elastic member by the cartridge (and main assembly). Therefore, the door has to be made more rigid than necessary to withstand the amount of the force to which it is subjected when it is opened or closed. Further, it makes larger the amount of force necessary to close the door.

Further, in the case of the above described technology disclosed in U.S. Pat. No. 6,453,136, when opening the door unit to replace the cartridge in the main assembly, the door unit has to be unlocked by operating a lever, whereas when closing the door unit after the replacement of the cartridge, the door unit has to be locked by operating the lever.

SUMMARY OF THE INVENTION

The primary object of the present invention is to provide a cartridge or an image forming apparatus which is simple in structure, and yet, can ensure that the cartridge properly positioned in the main assembly of the image forming apparatus does not move out of the main assembly through the opening with which the main assembly is provided to mount or remove the cartridge.

According to an aspect of the present invention, there is provided a cartridge detachably mountable to a main assembly of the image forming apparatus. The main assembly includes an opening, an urging portion, a positioning portion and a regulating portion. The cartridge comprises a portion to be urged by the urging portion so as to be moved in a crossing direction which crosses an inserting direction in which the cartridge is inserted, after the cartridge is inserted into the main assembly of the apparatus through the opening. The cartridge also comprises a portion to be positioned by contacting the positioning portion by the cartridge being moved by the urging portion in the crossing direction to position the cartridge relative to the main assembly of the apparatus. The cartridge also comprises a portion to be regulated by the regulating portion so as to prevent the cartridge from moving toward the outside of the main assembly through the opening in a state that the portion to be positioned is in contact to the positioning portion. The portion to be regulated is provided at a rear end of the cartridge and is brought, by movement of the cartridge in the crossing direction by the urging portion, to a regulating position where the portion to be regulated is behind the regulating portion with respect to the inserting direction to prevent the cartridge from moving toward the outside through the opening.

According to another aspect of the present invention, there is provided an image forming apparatus for forming an image on a recording, material. The apparatus comprises a main assembly including an opening, an urging portion, a positioning portion and a regulating portion. The apparatus also comprises a cartridge dismountably mounted to the main assembly. The cartridge includes a portion to be urged by the urging portion so as to be moved in a crossing direction which crosses an inserting direction in which the cartridge is inserted, after the cartridge is inserted into the main assembly of the apparatus through the opening. The cartridge also comprises a portion to be positioned by contacting the positioning portion by the cartridge being moved by the urging portion in the crossing direction to position the cartridge relative to the main assembly of the apparatus. The cartridge also comprises a portion to be regulated by the regulating portion so as to prevent the cartridge from moving toward the outside through the opening in a state that the portion to be positioned is in contact with the positioning portion. The portion to be regulated is provided at a rear end of the cartridge and is brought, by movement of the cartridge in the crossing direction by the urging portion, to a regulating position where the portion to be regulated is behind the regulating portion with respect to the inserting direction to prevent the cartridge from moving toward the outside through the opening.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

General Description of Image Forming Apparatus

Figure 1:
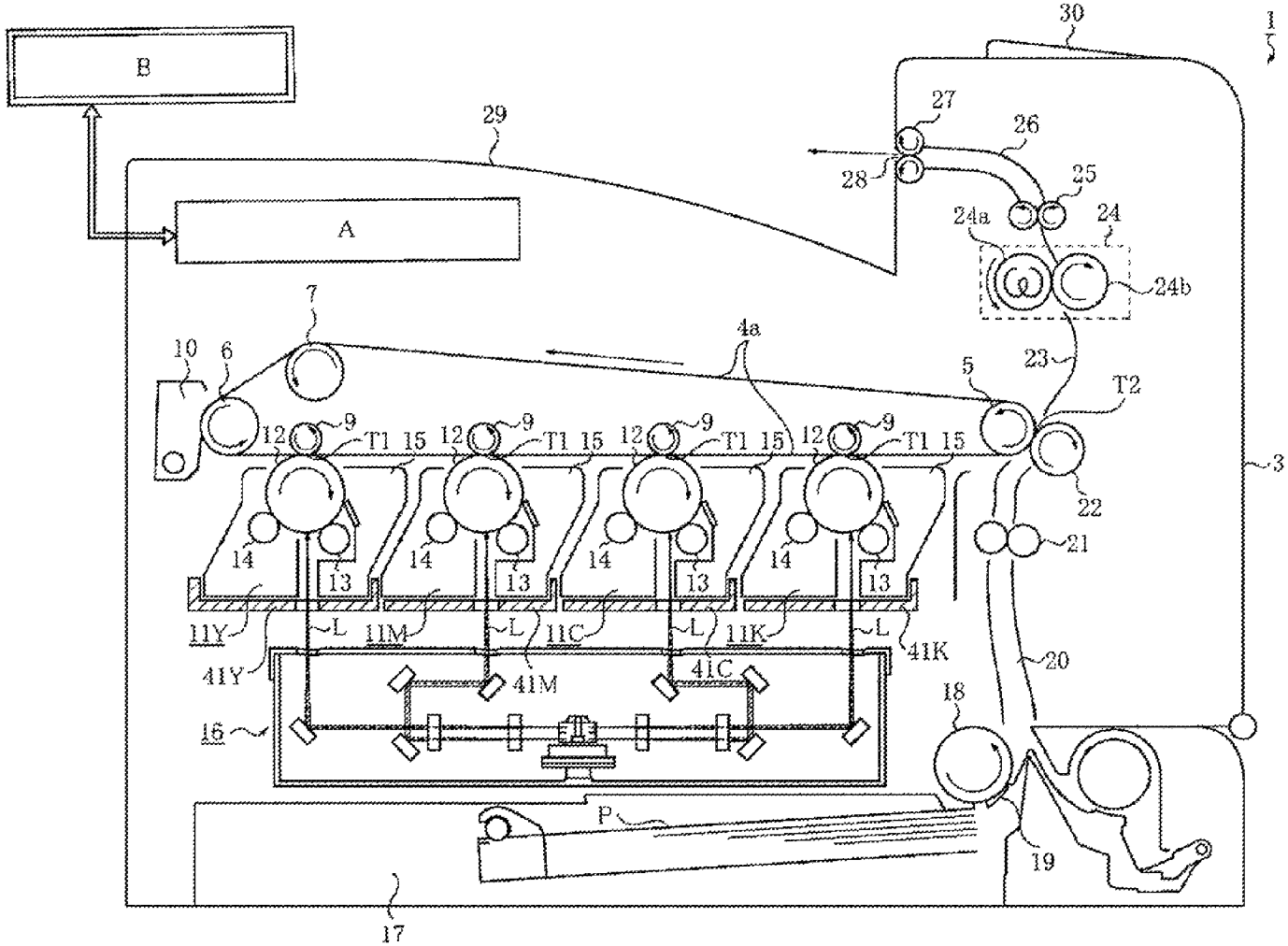
FIG. 1 is a sectional view of the image forming apparatus in the first preferred embodiment of the present invention, and shows the image forming operation of the apparatus.

First, referring to FIG. 1, the image forming apparatus in the first preferred embodiment will be described regarding its overall structure. FIG. 1 is a sectional view of the image forming apparatus in the first embodiment.

The image forming apparatus 1 shown in FIG. 1 employs four process cartridges 11 (11Y, 11M, 11C, and 11K). It is structured so that as the four process cartridges are mounted into its main assembly 3, they are aligned horizontally in a straight line (they horizontally align in tandem). Further, the main assembly 3 of the image forming apparatus 1, and the four process cartridges 11 (which hereafter will be referred to simply as cartridges), are structured so that the cartridges 11 can be independently mounted into, or removed from, the main assembly 3, from each other.

The main assembly 3 of the image forming apparatus is what remains after the removal of all of the process cartridges 11 from the image forming apparatus 1.

The front side (surface or wall) of the image forming apparatus 1 is the side (surface or wall) provided with a door 2 for covering or exposing the entrance of the cartridge chamber of the main assembly 3. The rear side is the opposite side from the front side. The left and right sides of the image forming apparatus 1 are the left and right sides as seen from the front side.

Referring again to FIG. 1, the cartridges 11Y, 11M, 11C, and 11K make up the first-fourth image formation stations of the image forming apparatus, which correspond to monochromatic yellow, magenta, cyan, and black images, into which an intended full-color image is separated. The cartridges 11Y, 11M, 11C, and 11K contain yellow, magenta, cyan, and black developers (which hereafter may be referred to as toners), respectively. Each cartridge 11 has an electrophotographic photosensitive drum 12. It also has electrophotographic processing means, more specifically, a charge roller 13 (charging means), a development unit 14 (developing means), a cleaning means, which are disposed in a manner to surround the peripheral surface of the photosensitive drum 12 in the circumferential direction of the photosensitive drum 12. The main assembly 3 of the image forming apparatus 1 is provided with a laser scanner unit 16, which is disposed so that it will be under the cartridges 11 after the mounting of the cartridges 11 into the main assembly 3. The main assembly 3 is also provided with an intermediary transfer belt unit (transferring means in the form of a belt; transferring-and-conveying means), which is disposed so that it will be on the top side of each photosensitive drum 12. The belt unit is for transferring an image (formed of developer) from the photosensitive drum 12 onto a recording medium P after the formation of the image on the photosensitive drum 12. The belt unit has an intermediary transfer belt 4*a*, a secondary transfer roller 5 (transfer roller on the inward side of belt loop), a follower roller 6, and a tension roller 7. The secondary transfer roller 5 and the follower roller 6 are disposed in the right and left end portions, respectively, of the main assembly 3. The tension roller 7 is disposed near the follower roller 6. The intermediary transfer belt 4*a* is suspended by the three rollers 5, 6, and 7. The intermediary transfer belt 4*a* (which hereafter will be referred to simply as belt 4*a*) is a flexible and endless belt. The abovementioned three rollers 5, 6, and 7 are disposed in parallel, with their rotational axial lines extending in the front-to-rear direction. The tension roller 7 is kept pressured upward to provide the intermediary transfer belt 4*a* with tension. There are the first to fourth primary transfer rollers 9 (primary transferring means), which are disposed on the inward side of the loop which the belt 4*a* forms. In terms of the direction parallel to the front (rear) wall of the main assembly 3, the four primary transfer rollers 9 are disposed in tandem between the follower roller 6 and the secondary transfer roller 5, in contact with the belt 4*a*, and with preset amount of intervals. There is also a belt cleaning unit 10 for cleaning the belt 4*a*, which is on the outward side of the abovementioned belt loop, corresponding in position to the follower roller 6.

Further, a secondary transfer roller 22 (transfer roller on the outward side of the belt loop) is disposed in contact with the belt 4*a*, on the outward side of the portion of the belt loop curved by the secondary transfer roller 22. The interface between the belt 4*a* and secondary transfer roller 22 is the secondary transfer portion T2.

The main assembly 3 of the image forming apparatus 1 is provided with a cassette chamber, which is in the bottom portion of the main assembly 3, and in which a cassette 17, storing recording media P (sheets of recording paper, for example), is mounted. The main assembly 3 is also provided with a recording medium conveying means, which extends from the cassette chamber to the top portion of the main assembly 3. The recording medium conveying means is made up of a pickup roller 18 (which corresponds in position to recording medium outlet of cassette 17), a recording medium passage 20, a pair of registration rollers 21, and a recording medium conveyance guide 23, listing from the upstream side in terms of the direction in which the recording medium P is conveyed.

The image forming operation of this image forming apparatus is as follows. First, each photosensitive drum 12 begins to be rotated with its own image formation timing, and is uniformly charged by its corresponding charge roller 13 across its peripheral surface. Then, the numerous points of the uniformly charged portion of the peripheral surface of each photosensitive drum 12 are selectively exposed by the laser scanner unit 16. As a result, an electrostatic latent image is formed on each photosensitive drum 12. Each development unit 14 develops the electrostatic latent image on its corresponding drum 12 by adhering toner to the latent image. Then, a bias which is opposite in polarity from the toner image is applied to each primary transfer roller 9. As a result, the image formed of toner on each photosensitive drum 12 is transferred onto the belt 4*a*. The above described steps of the image forming process are sequentially carried out in the first to fourth image formation stations. Thus, four monochromatic toner images, different in color, are transferred in layers onto the belt 4*a*, composing (synthetically effecting) thereby an unfixed full-color toner image on the belt 4*a*. Then, the unfixed full-color toner image is conveyed to the secondary transfer portion T2 by the rotation of the belt 4*a*.

Meanwhile, the recording media P in the cassette 17 are sequentially sent out into the recording medium conveyance passage 20 (which hereafter will be referred to simply as recording medium passage 20) by the pickup roller 18 while being separated so that only the top one will be sent into the recording medium passage 20. After each recording medium P is sent into the recording medium passage 20, it is conveyed to the secondary transfer portion T2 by the pair of registration rollers 21 with a preset timing. Then, while the recording medium P is conveyed through the second transfer portion T2, the application of a transfer bias to the second transfer roller 22 (roller outside belt loop) is started with a preset timing. As a result, the monochromatic toner images, different in color, on the belt 4*a*, are transferred all at once (secondary transfer) onto the recording medium P, forming an unfixed multi-color image on the recording medium P. Then, the recording medium P is conveyed out of the secondary transfer portion T2, is separated from the belt 4*a*, and is conveyed further by the recording medium conveyance guide 23 to the fixation unit 24. While the recording medium P is conveyed through the fixation unit 24, the recording medium P and the multi-color image thereon are subjected to heat and pressure by the heat roller 24*a* and pressure roller 24*b* of the fixation unit 24. As a result, the unfixed multi-color image is fixed to the surface of the recording medium P. Then, the recording medium P is conveyed further by a pair of first discharge rollers 25 through a recording medium passage 26, and then, is discharged from a delivery opening 28 onto a delivery tray 29, which is a part of the top surface of the frame (shell) of the main assembly 3. Meanwhile, the toner remaining on the peripheral surface of the photosensitive drum 12 after the transfer (primary transfer) of the toner image from the photosensitive drum 12 onto the belt 4*a* is removed by a cleaning member 70 to prepare the photosensitive drum 12 for the next image formation cycle. Similarly, the toner remaining on the belt 4*a* after the transfer (secondary transfer) of the toner images from the belt 4*a* onto the recording medium P is removed by the belt cleaning unit 10 to prepare the belt 4*a* for the next image formation cycle.

(Cartridge)

Figure 4:
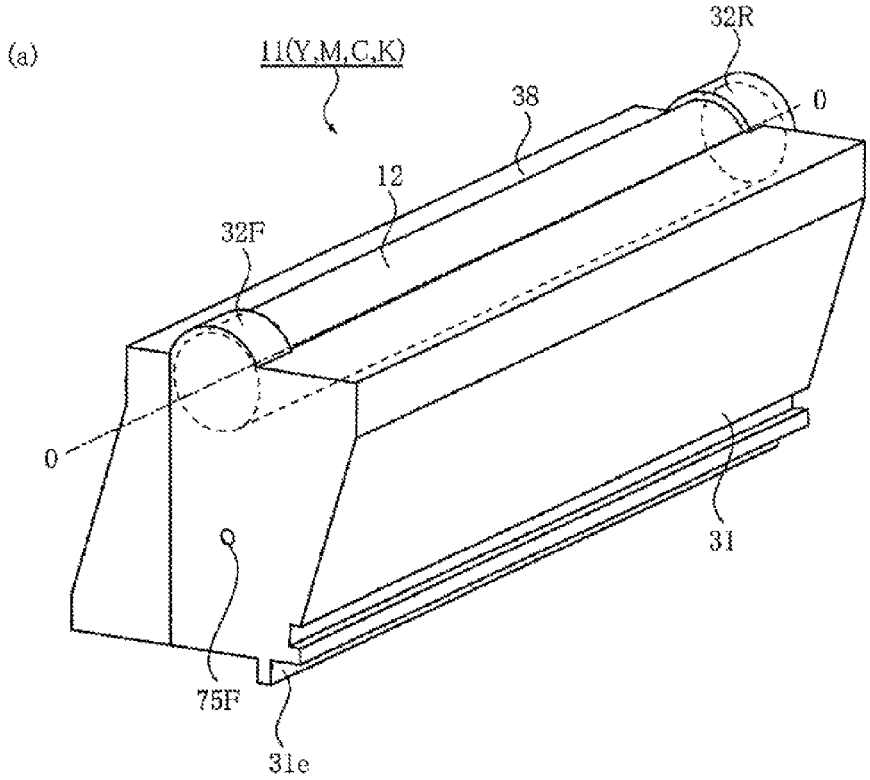
FIGS. 4(*a*) and 4(*b*) are external perspective views of the cartridge in the first preferred embodiment, as seen from the rear and front sides, respectively, of the cartridge in terms of the direction in which it is mounted into the main assembly of the image forming apparatus.
Figure 4:
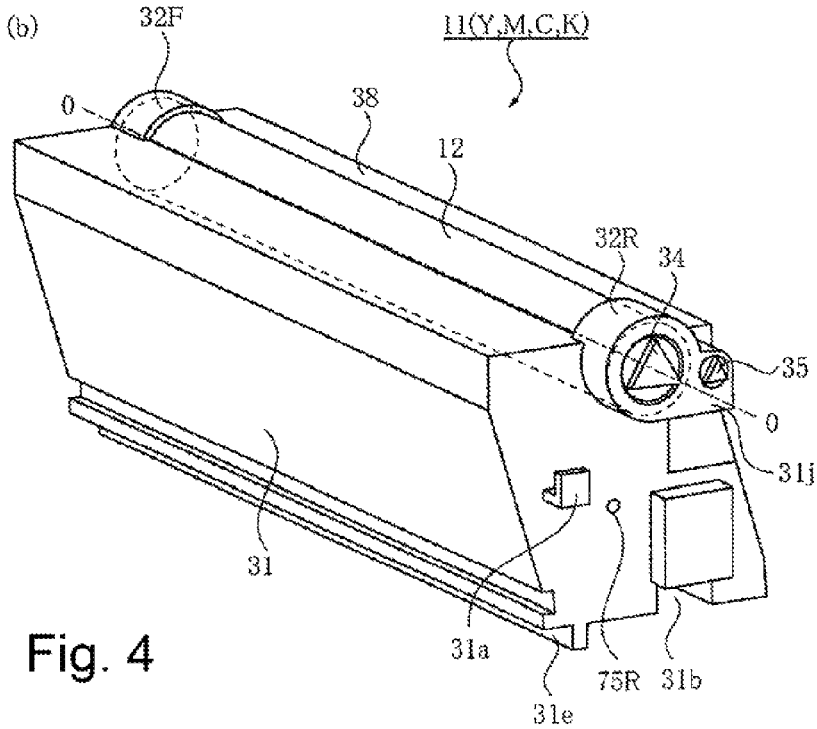
Figure 5:
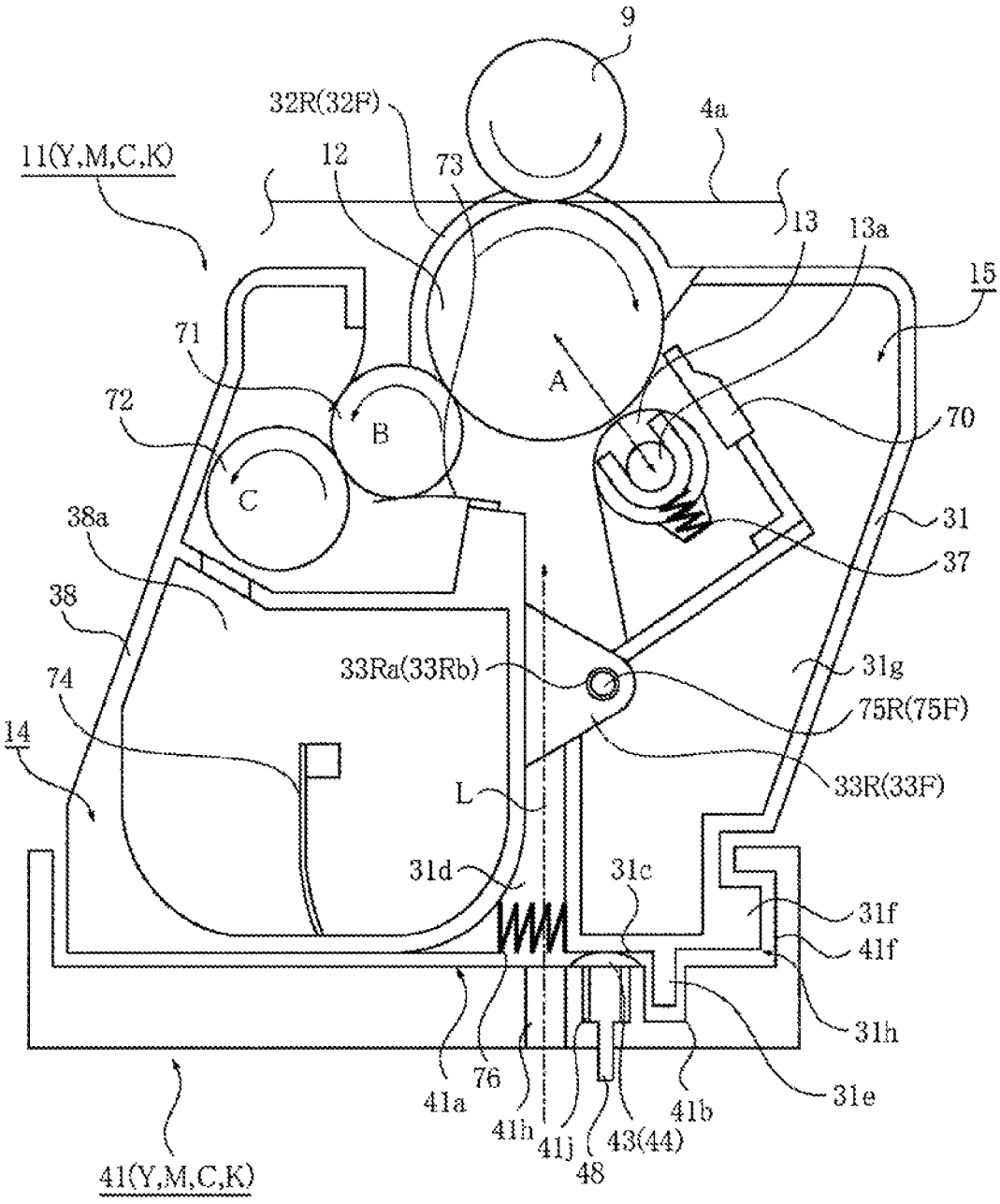
FIG. 5 is a sectional view of the cartridge in the first preferred embodiment.

Next, referring to FIGS. 4(*a*), 4(*b*), 5, and 7, the cartridge 11 in this embodiment will be described. FIGS. 4(*a*) and 4(*b*) are external perspective views of the cartridge in the first preferred embodiment, as seen from the rear and front sides, respectively, of the cartridge in terms of the direction in which it is mounted into the main assembly of the image forming apparatus. FIG. 5 is an enlarged sectional view of the cartridge 11 after the proper positioning of the cartridge 11 in the main assembly 3 of the image forming apparatus 1, and the adjacencies of the cartridge 11. That is, FIG. 5 shows the cartridge 11 which is ready for image formation. Incidentally, the cartridges 11Y, 11M, 11C, and 11K, which contain yellow, magenta, cyan, and black toners, respectively, are the same in structure. Referring to FIGS. 4(*a*) and 4(*b*), each cartridge 11 is an assembly, the lengthwise direction of which is parallel to the rotational axis of its photosensitive drum 12. Each cartridge 11 is provided with a drum driving coupling 34 and a development roller driving coupling 35, which are located at the front (deepest) end of the cartridge 11 in terms of the direction in which the cartridge 11 is inserted into the main assembly 3 of the image forming apparatus 1. Further, each cartridge 11 is provided with a cartridge position regulating portion 31*a* (cartridge displacement preventing portion) and a thrust lever catching portion 31*b*, which are at the front end portion of the cleaning unit frame 31 in terms of the direction in which the cartridge 11 is inserted into the main assembly 3. In terms of the direction perpendicular to the direction in which the cartridge 11 is inserted, the cartridge position regulating portion 31*a* is located roughly at the middle of the cleaning unit frame 31. It is ensured that the cartridge 11 is kept properly positioned in the main assembly 3 by the cartridge position regulating portion 31*a* because portion 31*a* is rigid.

The drum driving coupling 34 is the coupling with which the cartridge 11 receives the force for driving its photosensitive drum 12 from the apparatus main assembly 3. The development roller driving coupling 35 is the coupling with which the cartridge 11 receives the force for driving its development roller 71 (FIG. 5) from the main assembly 3.

Referring to FIG. 5, the cartridge 11 has an electrostatic latent image formation unit 15 (which hereafter will be referred to as the latent image formation unit) and the development unit 14.

The latent image formation unit 15 has the photosensitive drum 12, the charge roller 13, the cleaning member 70, and the cleaning means frame 31. It is the cleaning unit frame 31 that the photosensitive drum 12 is rotatably attached to with the bearings (32F and 32F) positioned as the photosensitive drum supporting members between the photosensitive drum 12 and cleaning unit frame 31. There are disposed the charge roller 13 and the cleaning member 70 in the adjacencies of the peripheral surface of the photosensitive drum 12 as described above. The abovementioned transfer residual toner is removed from the peripheral surface of the photosensitive drum 12 by the cleaning member 70, and falls into a chamber 31*g* for removed toner. The photosensitive drum 12 is rotated, in coordination with the progression of an image forming operation, by transmitting a driving force from a motor (an unshown source for driving the photosensitive drum 12) to the photosensitive drum 12 through the drum driving coupling 34. A pair of bearings for the charge roller 13 are attached to the cleaning unit frame 31 so that they can be moved relative to the cleaning unit frame 31 in the direction indicated by an arrow mark A. More concretely, the shaft 13*a* of the charge roller 13 is rotatably borne by the charge roller bearings. Each bearing is kept pressured toward the photosensitive drum 12 by a charge roller pressing member 37. The charge roller 13 is rotated by the rotation of the photosensitive drum 12.

The development unit 14 (developing apparatus) has the development roller 71 (developer bearing member) and a development unit frame 38. The development roller 71 rotates in contact with the photosensitive drum 12 in the direction indicated by an arrow mark B. It is rotatably supported by the development unit frame 38 with the interposition of a pair of development roller bearings (unshown) between the lengthwise ends of the development roller shaft and the development unit frame 38, respectively. The development unit 14 is provided with a toner supply roller 72 and a development blade 73, which are disposed in contact with the peripheral surface of the development roller 71. The toner supply roller 72 rotates in contact with the development roller 71 in the direction indicated by an arrow mark C. The development blade 73 is for regulating the thickness of the layer of toner as the layer of toner is formed on the peripheral surface of the development roller 71. The development unit frame 38 also has a toner storage portion 38*a*, in which a toner stirring member 74 is disposed, which is for conveying the toner in the toner storage portion 38*a* to the abovementioned toner supply roller 72 while stirring the toner.

Further, the development unit 14 has a pair of bearings 33F and 33R, which have holes 33Rb and 33Ra, respectively. Further, the development unit 14 is provided with a pair of shafts 75F and 75R, which are fitted in the holes 33Rb and 33Ra, respectively, connecting thereby the development unit 14 and latent image formation unit 15 in such a manner that the development unit 14 and the latent image formation unit 15 are allowed to rotationally move about the pair of shafts 75F and 75R. During an image forming operation, the development unit 14 of the cartridge 11 is kept under the pressure from a pair of compression springs 76, and therefore, the development roller 71 remains in contact with the photosensitive drum 12.

The bottom portion 31*h* of the cleaning unit frame 31 is provided with a pressure catching portion 31*c* (cartridge pressing member catching portion), which extends in the lengthwise direction of the cartridge 11. It is also provided with a cartridge guiding portion 31*e* (which hereafter will be referred to simply as guiding rib 31*e*). Incidentally, the cartridge 11 is provided with a slit 31*d*, which is a gap between the bottom portion of the development unit 14 and the bottom portion of the latent image formation unit 15, through which a beam of laser light is allowed to enter the cartridge 11. In terms of the widthwise direction of the cartridge 11, the slit 31*d* and the guiding rib 31*e* are roughly at the middle of the cartridge 11. Further, the latent image formation unit 15 is provided with a cartridge regulating upper rib 31*f*, which is the right end portion of the bottom portion of the latent image formation unit 15 in terms of the direction in which the cartridge 11 is inserted into the apparatus main assembly 3 (which hereafter will be referred to simply as cartridge insertion direction).

(Method for Mounting Cartridge)

Next, the method for mounting the cartridge 11 into the main assembly 3 of the image forming apparatus 1 will be described.

Figure 2:
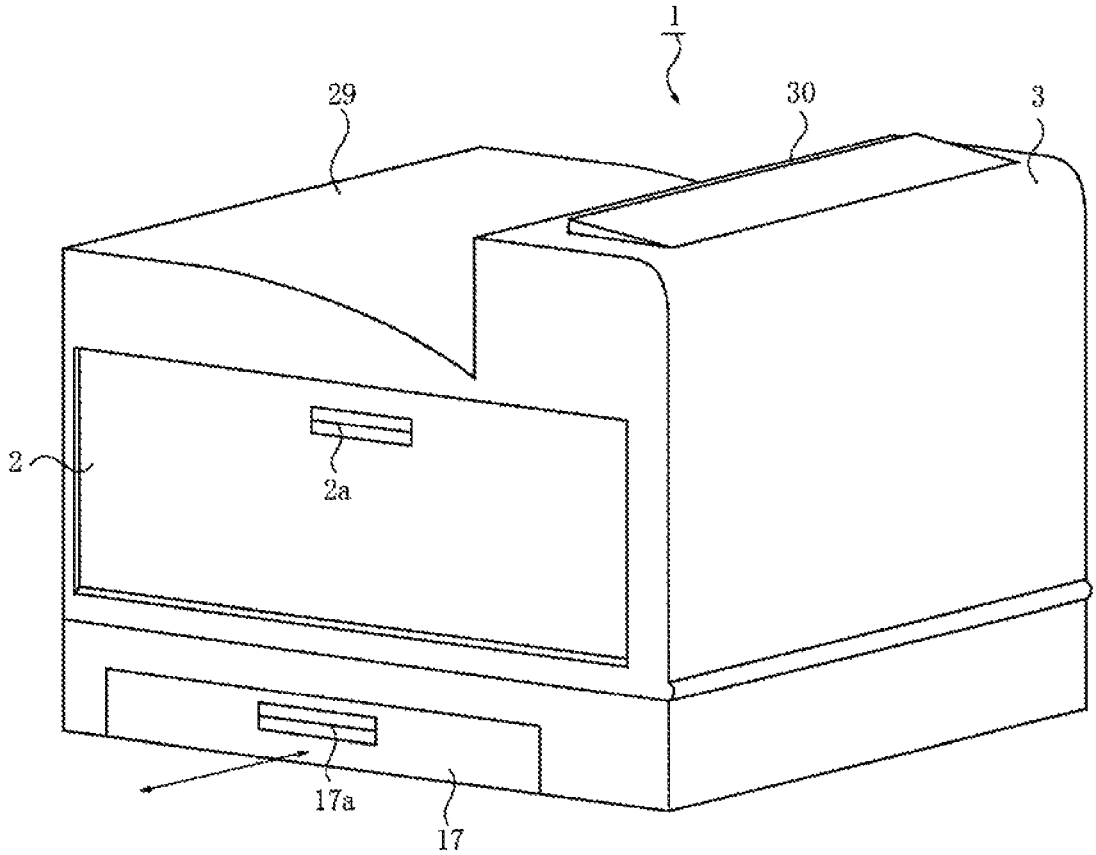
FIG. 2 is an external perspective view of the image forming apparatus in the first embodiment.
Figure 3:
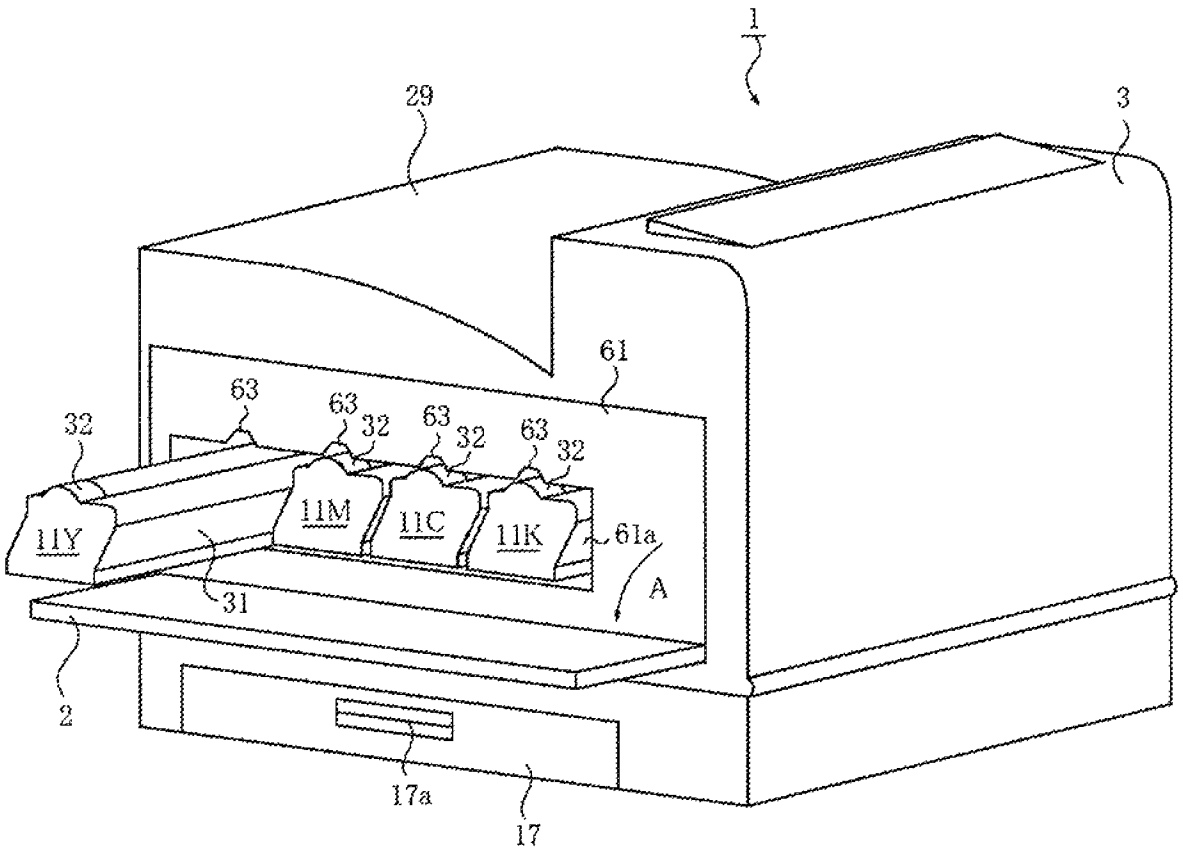
FIG. 3 is an external perspective view of the image forming apparatus, the door of which is open, and one of the four cartridges for which is being inserted or pulled out.

FIG. 2 is an external perspective view of the image forming apparatus 1. FIG. 3 is an external perspective view of the image forming apparatus 1 when the door 2 of the main assembly 3 is open and one of the four cartridges 11 for the image forming apparatus is being inserted into, or pulled out of, the main assembly 3.

Referring to FIG. 2, in the case of the image forming apparatus 1 in this embodiment, the door 2, and the opening 61*a* of the cartridge chamber of the apparatus main assembly 3, are on the front side of the apparatus main assembly 3. The door 2 is for exposing or covering up the opening 61*a*. The door 2 is provided with a handhold 2*a*. The opening 61*a* can be accessed by opening the door 2 in the direction indicated by an arrow mark A to replace the cartridge 11 or cartridges 11 in the main assembly 3.

Figure 6:
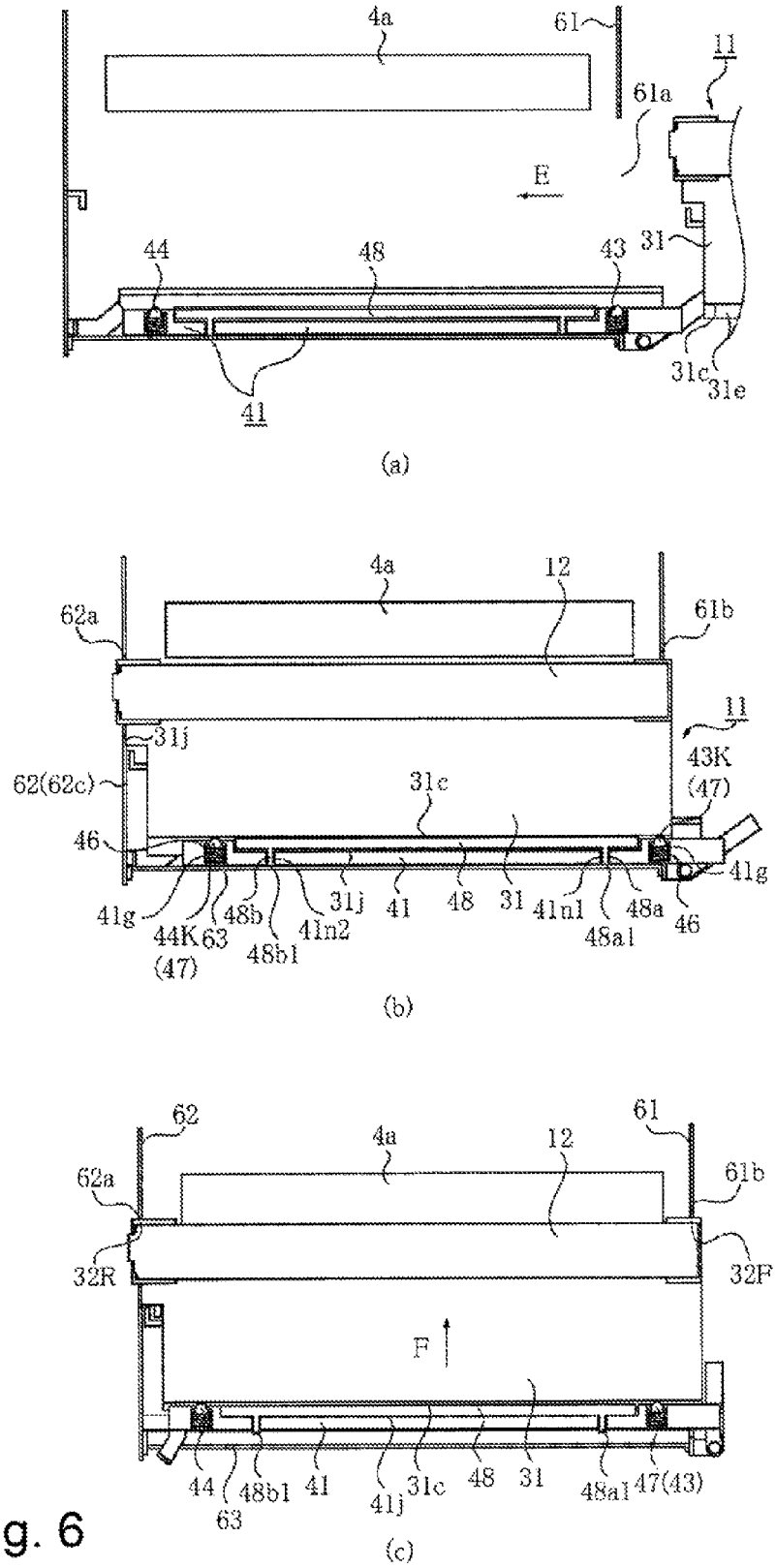
FIGS. 6(*a*)-6(*c*) show a combination of the drawings of the cartridge and the main assembly 3, as seen from the left side of the main assembly 3, which are for illustrating the operation for mounting the cartridge 11 into the main assembly 3.

FIGS. 6(*a*)-6(*c*) are drawings of the main assembly 3 and the cartridge 11, as seen from the left side of the main assembly 3, and are for illustrating the operation for mounting the cartridge 11 into the main assembly 3.

FIG. 6(*a*) illustrates the state of the cartridge 11 and the apparatus main assembly 3 prior to the mounting of the cartridge 11 into the apparatus main assembly 3. In the case of this image forming apparatus 1, the opening 61*a* is a part of the front wall 61 of the frame of the apparatus main assembly 3. The apparatus main assembly 3 is provided with a cartridge holding member 41 (which hereafter will be referred to simply as the tray), which has a rail 48 and a pair of cartridge pressing members 43 and 44. While the apparatus main assembly 3 and the cartridge 11 are in the state shown in FIG. 6(*a*), the top portions of the rail 48 and cartridge pressing members 43 and 44 are above the top surface of the tray 41.

The cartridge 11 is inserted into the apparatus main assembly 3 through the opening 61*a* in the direction indicated by an arrow mark E. In other words, the cartridge 11 is inserted into the apparatus main assembly 3 in the direction parallel to the rotational axis of the photosensitive drum 12. As the cartridge 11 is inserted into the apparatus main assembly 3, it comes to be supported, and remains supported thereafter, by the rail 48 and pressing members 43 and 44, by the pressure catching portion 31*c* of the cartridge 11. During the insertion of the cartridge 11 into the apparatus main assembly 3, the cartridge 11 is guided in the following manner (FIG. 5). That is, in terms of the vertical direction, the cartridge 11 is guided by the cartridge position regulating upper rib 31*f*, with which the cartridge 11 is provided, and the cartridge guiding top groove 41*f*, with which the tray 41 is provided. In terms of the left-to-right direction (horizontal direction), the cartridge 11 is guided by the guide rib 31*e* of the cartridge 11, and the cartridge guiding rib 41*b* with which the tray 41 is provided.

FIG. 6(*b*) illustrates the state of the cartridge 11 and apparatus main assembly 3 after the insertion of the cartridge 11 into the apparatus main assembly 3 all the way (the deepest position in apparatus main assembly 3). As the cartridge 11 is inserted in the direction indicated by the arrow mark E, a main assembly contacting portion 31*j*, which is an integral part of the cleaning unit frame 31, comes into contact with the inward surface 62*c* of the rear wall 62 of the main assembly frame of the apparatus main assembly 3, preventing thereby the cartridge 11 from being further moved in the cartridge insertion direction; the cartridge 11 is positioned in its deepest position in the apparatus main assembly 3. When the cartridge 11 is in this deepest position in the apparatus main assembly 3, the tray 41 is under the cartridge 11. This contact between the inward surface of the rear wall 62 of the frame of the apparatus main assembly 3 and the main assembly contacting portion 31*j* of the cartridge 11 determines the position of the cartridge 11 relative to the apparatus main assembly 3 in terms of the lengthwise direction of the cartridge 11. However, when the cartridge 11 is in the above described position, the operation for properly positioning the cartridge 11 relative to the apparatus main assembly 3 has not been completed, and further, the photosensitive drum 12 has not come into contact with the belt 4*a* of the intermediary transfer belt unit.

FIG. 6(*c*) illustrates the state of the cartridge 11 and apparatus main assembly 3 after the completion of the operation for mounting the cartridge 11 into the apparatus main assembly 3. After the cartridge 11 is inserted into its deepest position in the apparatus main assembly 3 in terms of the cartridge insertion direction, through the opening 61*a*, the tray 41, which is holding the cartridge 11, is moved in the direction perpendicular to the cartridge insertion direction by a tray raising mechanism, which will be described later; the tray 41 is moved upward while remaining horizontal. This upward movement of the tray 41 causes the rail 48 to downwardly displace relative to the tray 41. As a result, the cartridge supporting portions (tray 31 and cartridge pressing members 43 and 44) press the pressure catching portion 31*c* of the cleaning unit frame 31 in the direction indicated by an arrow mark F (direction perpendicular to cartridge insertion direction). Not only do the bearings 32F and 32R, with which the lengthwise ends, one for one, of the cleaning unit frame 31 are provided, have the function of supporting the photosensitive drum 12 as described above, but also, they function as the portions for accurately positioning the cartridge 11 relative to the apparatus main assembly 3. Further, in order to accurately position the cartridge 11 relative to the apparatus main assembly 3, the front and rear walls 61 and 62 of the main assembly frame are provided with cartridge positioning portions 61*b* and 62*a*, respectively. Thus, as the abovementioned pressure applying portions press the pressure catching portion 31*c* in the direction indicated by the arrow mark F, the bearings 32F and 32R come into contact with the cartridge positioning portions 61*b* and 62*a*, respectively, and further, the photosensitive drum 12 comes into contact with the belt 4*a*; in other words, the operation for accurately positioning the cartridge 11 relative to the apparatus main assembly 3 ends (cartridge mounting operation is completed).

That is, the inward surface 62*c*, with which the main assembly contacting portion 31*j* is placed in contact, and the cartridge positioning portions 61*b* and 62*a*, with which the bearings 32F and 32R are placed in contact, are the cartridge positioning portions of the apparatus main assembly 3.

The tray 41 is enabled to take a first position (FIGS. 6(*a*) and 6(*b*)), and a second position (FIG. 6(*c*)). The first position (FIGS. 6(*a*) and 6(*b*)) is the position which allows the cartridge 11 to be inserted into the apparatus main assembly 3, whereas the second position (FIG. 6(*c*)) is the position into which the cartridge 11 is moved, in the direction (upward) perpendicular to the cartridge insertion direction, to accurately position the cartridge 11 relative to the cartridge positioning portions of the apparatus main assembly 3.

(Structures of Tray Raising Mechanism and Tray)

Figure 7:
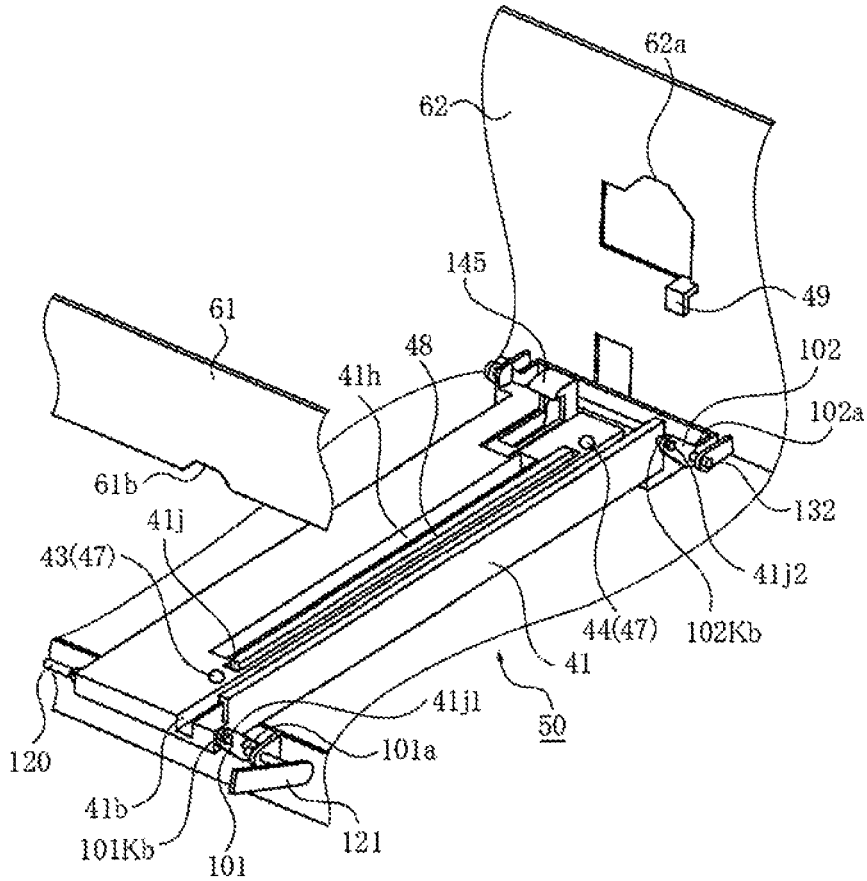
FIG. 7 is a perspective view of the tray raising mechanism which is in its second position.
Figure 8:
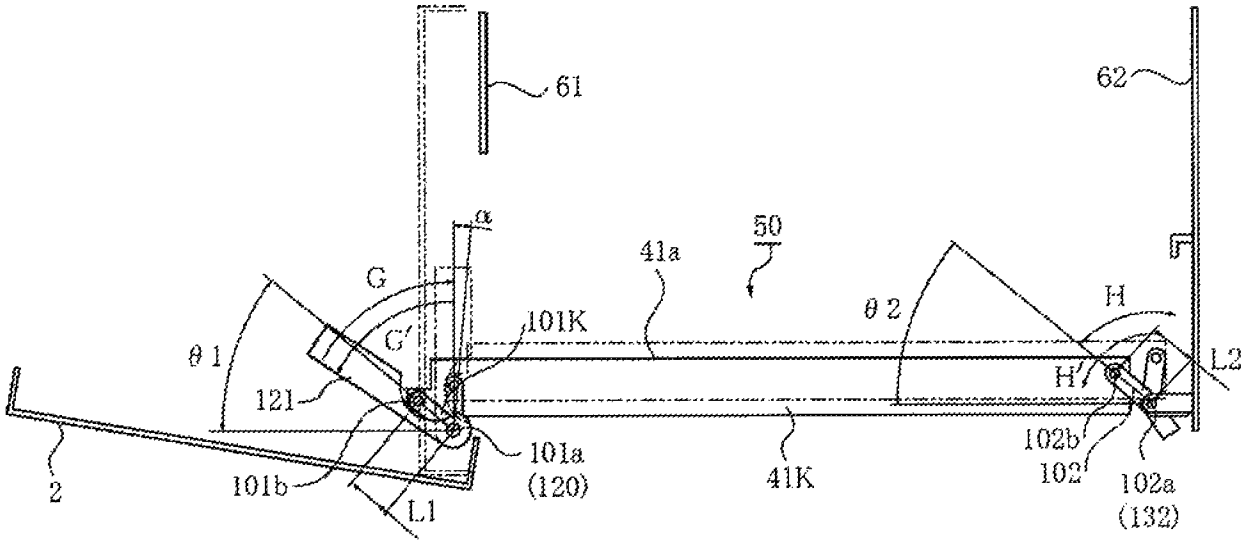
FIG. 8 is a side view of the tray raising mechanism, which is for illustrating how the tray is raised or lowered by the mechanism.
Figure 9:
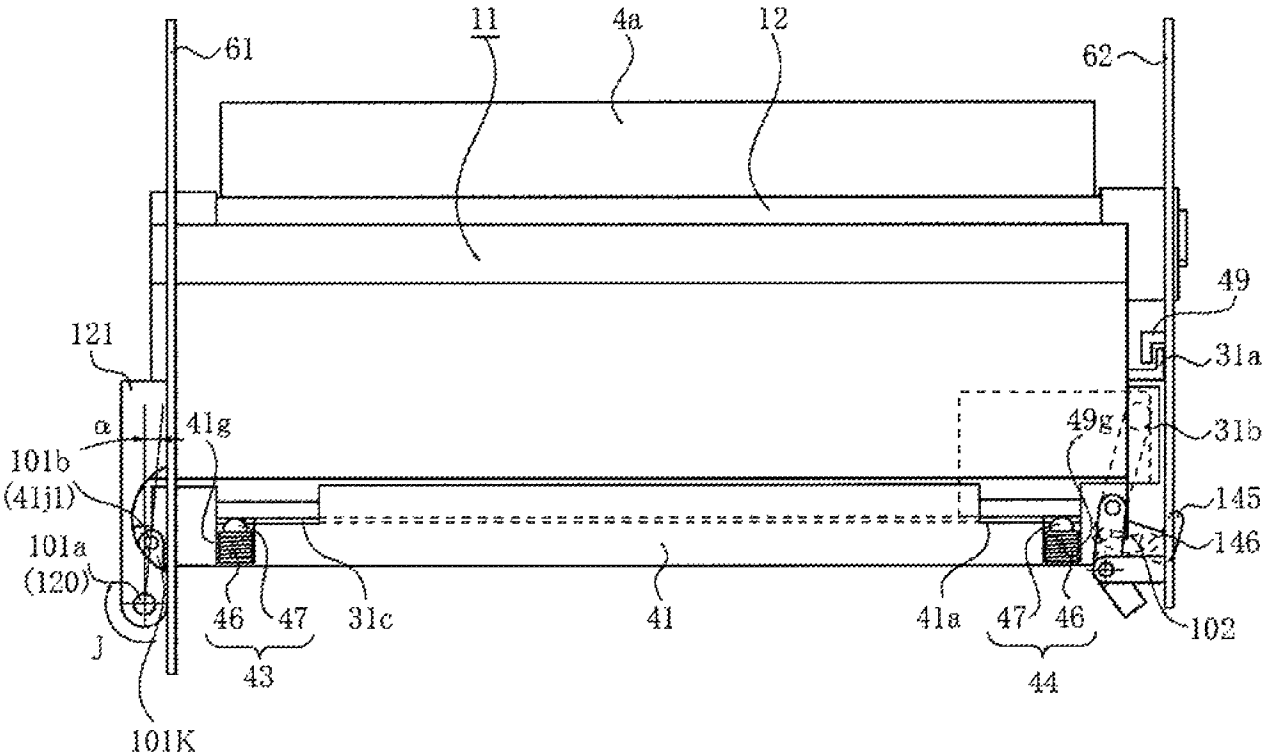
FIG. 9 is a partially sectional and vertical side view of a combination of the tray, tray raising mechanism in its first position, and cartridge on the tray.

Next, the tray 41 and the tray raising mechanism 50 of the apparatus main assembly 3 will be described in terms of their structure. FIG. 7 is a perspective view of the tray raising mechanism when the tray 41 is in its second position. FIG. 8 is a side view of the tray 41, tray raising mechanism, and its adjacencies, and is for illustrating the operation for raising or lowering the tray 41. In FIGS. 7 and 8, the first positions of the tray 41, the tray arms 101 and 102, and the door 2 are indicated by solid lines, whereas the second positions of the tray 41, the tray arms 101 and 102, and the door 2 are indicated by double-dot chain lines. FIG. 9 is a side view of the tray raising mechanism and cartridge 11, as seen from the direction perpendicular to the lengthwise direction of the cartridge 11, when they are in their second positions.

First, the structure of the tray 41 will be described. All trays 41 (41Y, 41M, 41C, and 41K), which support the cartridges 11 (11Y, 11M, 11C, and 11K), respectively, are the same in structure.

Referring to FIG. 5, the tray 41 roughly matches in shape and size the bottom portion 31*h* of the cartridge 11. Referring to FIG. 7, the tray 41 is provided with an opening 41*h* for allowing a beam of laser light (which hereafter will be referred to as exposure opening) to enter the cartridge 11. The exposure opening 41*h* is roughly at the center of the tray 41, in terms of the widthwise direction of the tray 41, and extends in the direction parallel to the lengthwise direction of the tray 41. When the cartridge 11 is in its designated position on the tray 41, the exposure opening 41*h* aligns with the opening 31*d* (exposure opening) of the cartridge 11 (FIG. 5). Thus, a beam of laser light L projected upward from the laser scanner unit 16 located below the tray 41 is allowed to reach the peripheral surface of the photosensitive drum 12 through the exposure openings 41*h* and 31*d*.

The tray 41 is provided with a guiding groove 41*b*, which is parallel to the exposure opening 41*h*. Referring to FIG. 5, the abovementioned guiding rib 31*e* of the cartridge 11 fits in the guiding groove 41*b* so that when the cartridge 11 is mounted into the apparatus main assembly 3, it is properly guided into the apparatus main assembly 3. In this embodiment, the guiding groove 41*b* and guiding rib 31*e* are matched in cross-sectional shape and dimension. That is, the cross section of the guiding rib 31*e* is such that its top surface is parallel to the cartridge insertion direction and its vertical surfaces are perpendicular to the cartridge insertion direction, whereas the cross section of the guiding groove 41*b* is such that its bottom surface is parallel to the cartridge insertion direction and its lateral surfaces are perpendicular to the cartridge insertion direction (top surface of the tray 41).

The tray 41 is provided with the abovementioned pair of pressing members 43 and 44, which are located on the front and rear sides, respectively, in terms of the cartridge insertion direction. Referring to FIG. 9, each of the pressing members 43 and 44 has a coil spring 46 and pressing portion 47, which are in one of the vertical holes 41*g* of the tray 41, with the pressing portion 47 placed on top of the coil spring 46 so that the pressing portion 47 is allowed to protrude above the top surface 41*a* of the tray 41.

Further, the tray 41 is provided with a recess 41*j*, and an auxiliary rail 48. The auxiliary rail 48 is in the recess 41*j*. Referring to FIG. 6(*b*), the auxiliary rail 48 is provided with a pair of support portions 48*a* and 48*b*. Further, the tray 41 is provided with a pair of through holes 41*n*1 and 41*n*2, in which the supporting portions 48*a* and 48*b* are fitted. Thus, the auxiliary rail 48 is supported by the tray 41 in such a manner that it is allowed to vertically side relative to the tray 41. When the tray 41 is in its first position, the rail supporting surfaces 48*a*1 and 48*b*1, that is, the bottom surfaces of the support portions 48*a* and 48*b*, respectively, of the auxiliary rail 48, are kept in contact with the bottom wall 63 of the apparatus main assembly 3 (which connects the front and rear walls 61 and 62 of the apparatus main assembly 3), by the weight of the auxiliary rail 48 itself; the auxiliary rail 48 is not allowed to move downward beyond where the bottom surface of the support portions 48*a* and 48*b* come into contact with the bottom wall 63 of the apparatus main assembly 3. Thus, when the tray 41 is in its first position, the top surface of the auxiliary rail 48 is roughly level with the top surface 41*a* of the tray 41, and the top of each of the pressing portions 47 of the pressing members 43 and 44. Therefore, as the cartridge 11 is inserted into, or taken out of, the apparatus main assembly 3 while the tray 41 is in its first position, the auxiliary rail 48 and pressing members 43 and 44 support the cartridge 11, by the pressure catching portions 31*c* of the cartridge 11.

On the other hand, referring to FIG. 6(*c*), when the tray 41 is in its second position, that is, its highest position, the bottom surfaces 48*a*1 and 48*b*1 of the rail supporting portions 48*a* and 48*b*, respectively, of the auxiliary rail 48 are not in contact with bottom wall 63 of the apparatus main assembly. Thus, the auxiliary rail 48 is supported by the bottom surface of the recess 41*j* of the tray 41, being completely fitted in the recess 41*j* of the tray 41. Thus, while the tray 41 is in the second position, each pressing portion 47 remains in contact with the corresponding pressure catching portion 31*c*, and keeps the bearings 32F and 32R pressed upon the positioning portions 61*b* and 62*a*, respectively, of the apparatus main assembly 3. Thus, while the tray 41 is in the second position, the photosensitive drum 12 and belt 4*a* remain in contact with each other.

Next, the structure of the tray raising mechanism will be described.

Referring to FIG. 7, the tray raising mechanism 50 is made up of the tray 41, the tray arms 101 and 102, a linking shaft 120, and a linking lever 121. The tray arm 101 is attached to the linking shaft 120, which is fitted in the first hole 101*a*, with which the tray arm 101 is provided. Thus, the tray arm 101 is supported by the front wall 61 of the apparatus main assembly so that it can be rotated about the axial line of the linking shaft 120. Further, the shaft 41*j*1 of the tray 41, which is on the front side of the tray, is fitted in the second hole 101*b*, with which the tray arm 101 is provided. That is, the shaft 41*j*1 is rotatably supported by the tray arm 101.

Further, the tray arm 102 is provided with the first hole 102*a*, and a supporting shaft 132 is fitted in the first hole 102 of the tray arm 102. Thus, the tray arm 102 is rotatably supported by the rear wall 62 of the apparatus main assembly 3. Further, the tray arm 102 is provided with a second hole 102*b*, and a shaft 41*j*2, with which the rear portion of the tray 41 is provided. Thus, the shaft 41*j*2 is rotatably supported by the tray arm 102.

Further, the linking shaft 120 is in connection to an unshown tray arm, which supports the tray 41 by the front side of the tray, like the linking shaft 120 of each of the other trays 41. Further, the linking shaft 120 is provided with the linking lever 121, which also corresponds to the counterpart of each of the other tray 41. Thus, as the linking lever 121 is rotated, the linking shaft 120 is rotated, whereby the tray arms 101 and 102 are synchronously rotated.

Next, referring to FIG. 8, L1 stands for the distance from the center of the first hole 101*a*, which coincides with the rotational axis of the tray arm 101, to the center of the second hole 101*b*, which coincides with the axial line of the shaft 41*j*1 of the tray 41. L2 stands for the distance from the center of the first hole 102*a*, which coincides with the rotational axis of the tray arm 101, to the center of the second hole 102*b*, in which the shaft 41*j*2 of the tray 41 is fitted. In this embodiment, L1 is equal to L2 (L1=L2).

Also referring to FIG. 8, θ1 stands for the angle between the straight line which connects the center of the first hole 101*a* of the tray arm 101 and the center of the second hole 101*b* of the tray arm 101, and the horizontal direction. Similarly, the θ2 stands for the angle between the straight line which connects the center of the first hole 102*a* of the tray arm 102 and the center of the second hole 102*b* of the tray arm 102, and the horizontal direction. In this embodiment, θ1 equals θ2 (θ1=θ2). Further, the main assembly 3 of this image forming apparatus 1 is structured so that while the tray 41 is in its second position, the top surface 41*a* of the tray 41 remains horizontal; the front and rear sides of the tray 41 remain at the same height.

As the linking lever 121 attached to the linking shaft 120 is rotated in the direction indicated by an arrow mark G, the tray arm 101 rotates about the axial line of the first hole 101*a* and the axial line of the linking shaft 120. This rotation of the tray arm 101 causes the tray 41 to move, causing thereby the tray arm 102 to rotate about the axial line of the first hole 102*a* and the axial line of the supporting shaft 132 in the direction indicated by an arrow mark H. Thus, the tray 41 supported by the tray arms 101 and 102 moves upward from its first position to its second position while remaining horizontal. On the other hand, as the linking lever 121 is rotated in the opposite direction, that is, the direction indicated by an arrow mark G', the tray arm 101 rotates about the axial line of the first hole 101*a* and the axial line of the linking shaft 120 in the direction indicated by the arrow mark G'. This rotation of the tray arm 101 causes the tray 41 to move, causing thereby the tray arm 102 to rotate about the axial line of the first hole 102*a* and the axial line of the supporting shaft 132 in the direction indicated by an arrow mark H'. Thus, the tray 41 supported by the tray arms 101 and 102 moves downward from the second position to the first position while remaining horizontal.

In this embodiment, the tray raising mechanism is structured so that in order to raise the tray 41 into its second position, the tray arm 101 has to be rotated far enough for the straight line, which connects the center of the first hole 101*a* and the center line of the second hole 102*b*, to move past the vertical line, which coincides with the center line of the first hole 101*a*, by an angle of α. This structural arrangement causes the combination of the weight of the cartridge 11 and the weight of the tray 41 to work in the direction to rotate the linking shaft 120 in the direction indicated by the arrow mark G (FIG. 8). Thus, it prevents the problem that the tray 41 moves down into the first position due to vibrations, falls, etc., which occur during the transportation (shipment) of the packaged image forming apparatus 1. In other words, it ensures that the tray 41 remains stable in the second position.

Also in this embodiment, the door 2 is connected to the linking lever 121 by a connecting means (unshown). Thus, the opening or closing of the door 2 causes the linking lever 121 to rotate. That is, as the door 2 is closed, the movement of the door 2 causes the linking lever 121 to be rotated in the direction indicated by the arrow mark G, causing thereby the tray 41 to move from the first position to the second position, whereas as the door 2 is opened, the movement of the door 2 causes the linking lever 121 to rotate in the direction indicated by the arrow mark G', causing thereby the tray 41 to move from the second position to the first position.

(Mechanism for Giving Pulling Cartridge During Mounting of Cartridge)

Figure 10:
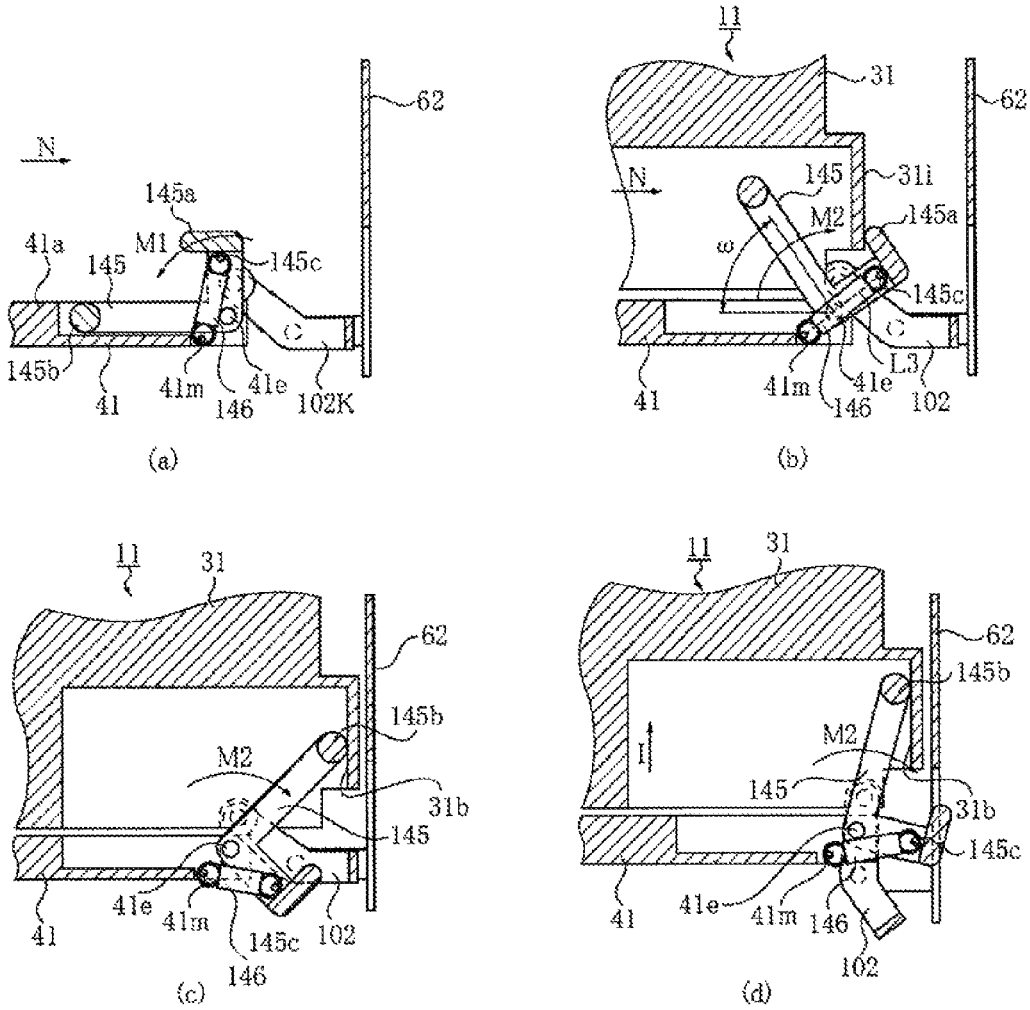
FIGS. 10(*a*)-10(*d*) are four schematic drawings of the mechanism for pulling the cartridge into the deepest end of the main assembly of the image forming apparatus, when mounting the cartridge into the main assembly, which are for illustrating the operation of the mechanism.

Next, referring to FIGS. 10(*a*)-10(*d*), the mechanism for pulling the cartridge 11 when the cartridge 1 is mounted into the apparatus main assembly 3, will be described. FIGS. 10(*a*)-10(*d*) are drawings illustrating the mechanism for pulling the cartridge 11 when the cartridge 11 is mounted into the apparatus main assembly 3, regarding the movements of various components of the mechanism.

FIG. 10(*a*) is a side view of the cartridge pulling mechanism prior to the mounting of the cartridge 11 into the apparatus main assembly 3. The tray 41 is provided with a thrust lever 145 and a thrust spring 146, which are located at the front end of the tray 41 in terms of the cartridge insertion direction. The thrust lever 145 is rotatably supported by the thrust lever supporting portion 41*e* of the tray 41. The thrust spring 146 is a tension spring, and functions as a pressure applying member. One end of the thrust spring 146 is attached to the shaft 41*m* of the tray 41, and the other end is attached to the shaft portion 145*c* of the thrust lever 145. Thus, the resiliency of the thrust spring 146 works in the direction to reduce the distance between the shaft portion 41*m* of the tray 41 and the shaft portion 145*c* of the thrust lever 145. In other words, the thrust lever 145 is under the moment, which works in the direction to rotate the thrust lever 145 in the direction indicated by an arrow mark M1 about the thrust lever supporting portion 41*e*. When the cartridge pulling mechanism is in the state shown in FIG. 10(*a*), the first arm portion 145*a* of the thrust lever 145 is above the top surface 41*a* of the tray 41, and the second arm portion 145*b* of the thrust lever 145 is within the tray 41 (below top surface 41*a* of tray 41). The cartridge 11 is inserted into the apparatus main assembly 3 from the front side of the apparatus main assembly 3 (as indicated by arrow mark N in FIG. 10(*a*)).

FIG. 10(*b*) is a side view of the cartridge pulling mechanism when the cartridge 11 is being mounted into the apparatus main assembly 3. As the cartridge 11 is inserted in the direction indicated by the arrow mark N, the front end surface 31*i* of the cleaning unit frame 31 presses the first arm portion 145*a*. As a result, the thrust lever 145 rotates about the supporting portion 41*e* in the direction indicated by an arrow mark M2, against the resiliency of the thrust spring 146. Thus, the first arm portion 145*a* rotates about the supporting portion 41*e* by ε° from the position in which it has been before the mounting of the cartridge 11 into the apparatus main assembly 3. During this rotation of the first arm portion 145*a*, the axial line of the supporting portion 41*e*, which is the rotational axis of the thrust lever 145, coincides with the straight line L3 (double-dot chain line in drawing), which connects the axial line of the shaft portion 41*m* of the tray 41 and the axial line of the shaft portion 145*c* of the thrust lever 145. Also during this rotation of the first arm portion 145*a*, the thrust lever 145 is in the neutral position, that is, the position in which it is not under the moment attributable to the resiliency of the thrust spring 146.

FIG. 10(*c*) is a side view of the cartridge pulling mechanism after the insertion of cartridge 11 into the deepest end of the apparatus main assembly 3. When the cartridge pulling mechanism is in the state shown in FIG. 10(*c*), the thrust lever 145 is under the pressure generated by the resiliency of the thrust spring 145 in the direction to place the shaft portion 41*m* of the tray 41 closer to the shaft portion 145*c* of the thrust lever 145. In other words, the thrust lever 145 is under the moment which acts in the direction indicated by the arrow mark M2. When the cartridge pulling mechanism is in this state, the second arm portion 145*b* of the thrust lever 145 comes into contact with the thrust lever catching portion 31*b* of the cartridge frame 31. As a result, the cartridge 11 is kept pressed toward the rear wall 62 of the apparatus main assembly 3 (in cartridge insertion direction).

FIG. 10(*d*) is a side view of the cartridge pulling mechanism after the completion of the operation for inserting the cartridge 11 into the apparatus main assembly 3. After the insertion of the cartridge 11 into the deepest end of the apparatus main assembly 3, the cartridge 11 is raised by the tray 41 in the direction indicated by an arrow mark I as described above, whereby it is properly positioned for image formation, relative to the apparatus main assembly 3. The thrust lever 145 remains under the force generated by the resiliency of the thrust spring 146 in the direction to reduce the distance between the shaft portion 41*m* of the tray 41 and the shaft portion 145*c* of the thrust lever 145. Therefore, the thrust lever 145 remains under the moment which acts in the direction indicated by the arrow mark M2. When the cartridge pulling mechanism is in this state, the second arm portion 145*b* of the thrust lever 145 is in contact with the thrust lever catching portion 31*b* of the cartridge frame 31, and keeps the cartridge 11 pressed toward the rear wall 62 of the frame of the apparatus main assembly 3 (keep cartridge 11 pressed in cartridge insertion direction).

That is, during the mounting of the cartridge 11 into the apparatus main assembly 3 by a user, while the thrust lever 145 is in between the state shown in FIG. 10(*a*) and the state shown in FIG. 10(*b*), the thrust lever 145 is under the pressure which works in the opposite direction from the cartridge insertion direction, whereas while the thrust lever 145 is in between the state shown in FIG. 10(*b*) and the state shown in FIG. 10(*c*), the thrust lever 145 is under the pressure which works in the same direction as the cartridge insertion direction. In other words, after the insertion of the cartridge 11 into its deepest position in the apparatus main assembly 3, the cartridge 11 remains under the pressure that works in the cartridge insertion direction.

(Mechanism for Preventing Cartridge from being Displaced (Popping Out))

Figure 11:
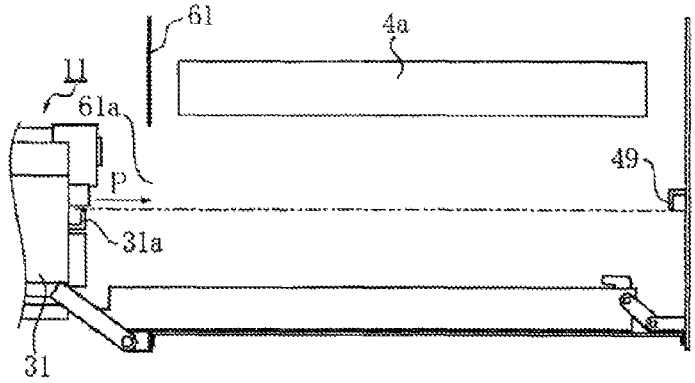
FIGS. 11(*a*)-11(*c*) are three schematic drawings of the mechanism for preventing the cartridge from popping out of the main assembly of the image forming apparatus after being precisely positioned in its second position, which are for illustrating the operation of the mechanism.
Figure 11:
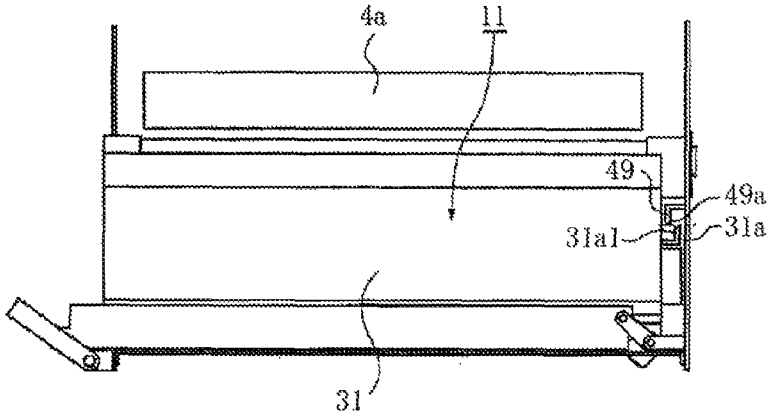
Figure 11:
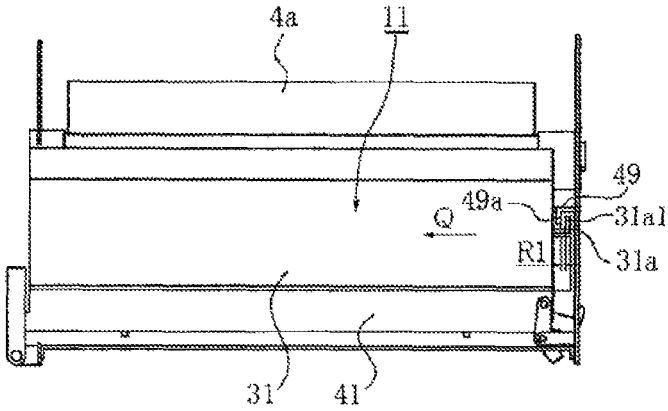

Next, the mechanism for preventing the problem that the cartridge 11 popping out of the apparatus main assembly 3 after it is properly mounted into the apparatus main assembly 3, will be described. FIGS. 11(*a*)-11(*c*) are for illustrating the mechanism for preventing the problem that the cartridge 11 is displaced after it is properly mounted into the main assembly 3.

First, the reason why the mechanism for preventing the cartridge 11 from being displaced after the cartridge 11 is properly mounted into the apparatus main assembly 3 is provided even though the apparatus main assembly 3 is provided with the thrust lever 145 described above, will be described. As described above, while the cartridge 11 is inserted into the apparatus main assembly 3, the thrust lever 145 remains under the pressure which works in the opposite direction from the cartridge insertion direction until the cartridge 11 reaches virtually the deepest end of the apparatus main assembly 3. Thus, if it is only with the thrust lever 145 that the image forming apparatus 1 is provided to prevent the cartridge 11 from being displaced after its proper insertion into the apparatus main assembly 3, the force necessary to insert the cartridge 11 into the apparatus main assembly 3 has to be greater than otherwise. In this embodiment, therefore, in order to prevent the cartridge 11 from being displaced after its proper mounting into the apparatus main assembly 3, the image forming apparatus 1 is provided with the cartridge displacement (pup-out) prevention mechanism.

Referring to FIGS. 11(*a*)-11(*c*), the cartridge 11 is provided with a cartridge displacement prevention portion 31*a* (cartridge position regulating portion), which is on the outward surface of the front wall of the cartridge frame 31 in terms of the cartridge insertion direction. The cartridge displacement prevention portion 31*a* is in the form of a letter L. That is, it horizontally extends in the cartridge insertion direction from the outside surface of the cartridge wall 31, and then, vertically extends upward. Further, the rear wall 62 of the main assembly 3 is provided with a cartridge displacement prevention portion 49 (cartridge position regulating portion), which is on the inward surface of the rear wall 62. The cartridge displacement prevention portion 46 also is in the form of a letter L. It horizontally extends from the rear wall 62, and then, vertically extends downward.

FIG. 11(*a*) illustrates the relationship between the cartridge displacement preventing portions 31*a* and 49 prior to the insertion of the cartridge 11 into the apparatus main assembly 3. The cartridge 11 is inserted into the apparatus main assembly 3 through the opening 61*a* of the front wall 61 of the apparatus main assembly 3 in the direction indicated by an arrow mark P in FIG. 11(*a*). Until the cartridges 11 reaches virtually the deepest end of the apparatus main assembly 3, the cartridge displacement preventing portions 31*a* and 49 of the cartridge 11 and apparatus main assembly 3, respectively, do not overlap with each other in terms of the cartridge insertion direction. Further, while the cartridge 11 is inserted into the apparatus main assembly 3, the cartridge 11 is prevented by the above described auxiliary rail 48, pressing members 43 and 44, and the cartridge movement regulating upper rib 31*f*, from moving in the vertical direction. Therefore, the cartridge displacement preventing portions 31*a* and 49 do not come into contact with each other until the cartridge 11 reaches virtually the deepest end of the apparatus main assembly 3 in terms of the cartridge insertion direction.

FIG. 11(*b*) illustrates the relationship between the cartridge displacement preventing portions 31*a* and 49 at the moment when the cartridge 11 has just reached the deepest end of the apparatus main assembly 3 in terms of the cartridge insertion direction. When the cartridge 11 is in the position shown in FIG. 11(*b*), the vertical surface 31*a*1 of the cartridge displacement preventing portion 31*a* is deeper in the apparatus main assembly 3 than the vertical surface 49*a* of the cartridge displacement preventing portion 49, in terms of the cartridge insertion direction. Also when the cartridge 11 is in the position shown in FIG. 11(*b*), the cartridge displacement preventing portions 31*a* and 49 of the cartridge 11 and apparatus main assembly 3, respectively, do not overlap with each other as seen from the front side of the main assembly 3. Therefore, while the cartridge 11 is in the position shown in FIG. 11(*b*), it can be taken out of the apparatus main assembly 3 without causing the cartridge displacement preventing portions 31*a* and 49 to come into contact with each other.

FIG. 11(*c*) illustrates the relationship between the cartridge displacement preventing portions 31*a* and 49 of the cartridge 11 and apparatus main assembly 3, respectively, after the completion of the mounting of the cartridge 11 into the apparatus main assembly 3. After the cartridge 11 is inserted into the deepest end of the apparatus main assembly 3 in terms of the cartridge insertion direction, the tray 41 is raised (from first position to second position) by the tray raising mechanism while remaining horizontal. Thus, the cartridge 11 is moved upward (in other words, cartridge 11 moves in direction perpendicular to cartridge insertion direction). While the cartridge is in the position shown in FIG. 11(*c*), the cartridge displacement preventing portions 31*a* and 49 of the cartridge 11 and apparatus main assembly 3, respectively, overlap with each other as seen from the cartridge insertion direction. That is, as the tray 41 is raised, the vertical portion of the cartridge displacement preventing portion 31*a* is placed into the space between the vertical portion of the cartridge displacement preventing portion 49 and the rear wall 61 of the apparatus main assembly 3. Thus, while the tray 41 is in the position shown in FIG. 11(*c*), the cartridge 11 cannot move in the direction indicated by an arrow mark Q more than a distance equivalent to the size of the gap R1 between the vertical surface 31*a*1 of the vertical portions of the cartridge displacement preventing portion 31*a*, and the vertical surface 49*a* of the vertical portion of the cartridge displacement preventing portion 49. That is, even if the cartridge 11 is moved in the direction indicated by the arrow mark Q by the vibrations and/or impacts which occur during the transportation of the image forming apparatus, the contact between the abovementioned vertical surfaces 31*a*1 and 49*a* prevents the cartridge 11 from moving more than the distance equivalent to the size of the gap R1. In other words, while the tray 41 is in the position shown in FIG. 11(*c*), that is, while the bearings 32F and 32R and the cartridge positioning portion 61*b* are in contact with each other, the cartridge 11 is not allowed to move outward of the opening 61*a*; the cartridge 11 does not pop out of the apparatus main assembly 3. On the other hand, if the cartridge 11 and the apparatus main assembly 3 are not provided with the cartridge displacement preventing portions 31*a* and 49, respectively, the cartridge 11 is likely to be made to pop out of the apparatus main assembly 3, by the abovementioned impacts or the like, because the bearings 32F and 32R remain in contact with only the cartridge positioning portion 61*b* of the apparatus main assembly 3, which is a part of the edge of the cartridge insertion opening 61*a*, while the cartridge 11 is in the second position in the main assembly 3.

The image forming apparatus 1 in this embodiment is structured so that after the cartridge 11 is properly positioned for image formation in the apparatus main assembly 3, there is the gap R1 between the cartridge displacement preventing portions 31*a* and 49 of the cartridge 11 and the apparatus main assembly 3, respectively, in terms of the cartridge insertion direction. Further, because the cartridge 11 is moved by the pressing members 43 and 44, the vertical portion of the cartridge displacement preventing portion 31*a* of the cartridge 11 moves deeper into the apparatus main assembly 3 than the cartridge displacement preventing portion 49, in terms of the cartridge insertion direction, without coming into contact with the cartridge displacement preventing portion 49. Therefore, the amount of the load to which a user of the image forming apparatus 1 in this embodiment is subjected when mounting the cartridge 11 into the apparatus main assembly 3 is smaller than that to which a user is subjected when mounting a conventional cartridge (11) into the apparatus main assembly 3 of a conventional image forming apparatus. However, the image forming apparatus 1 may be structured so that while the tray 41 is in its first position, the cartridge displacement preventing portions 31*a* and 49 remain in contact with each other; there is no gap between the two portions 31*a* and 49.

As described above, the image forming apparatus in this embodiment is structured so that as the tray 41 is raised into its second position, the cartridge 11 is positioned so that its cartridge displacement preventing portion 31*a* overlaps with the cartridge displacement preventing portion 49 of the apparatus main assembly 3 in terms of the cartridge insertion direction. Therefore, even if the image forming apparatus 1 is transported with the cartridge 11 mounted in the apparatus main assembly 3, it does not occur that the cartridge 11 is made to pop out of its image forming position in the direction opposite to the cartridge insertion direction, by the impacts, vibrations, etc., which are transmitted thereto from outside. Further, the provision of the cartridge displacement preventing portions 49 and 31*a* makes it possible to reduce in amount the pressure to be applied to the thrust lever 141, making thereby it possible to reduce in amount the force necessary to insert the cartridge 11 into the apparatus main assembly 3.

That is, the present invention makes it possible to transport the image forming apparatus 1 with the cartridge 11 mounted in the apparatus main assembly 3, making it thereby possible to reduce in size the box in which the combination of the main assembly of an image forming apparatus, and a cartridge (cartridges) therefore are packed when the apparatus main assembly 3 and cartridge 11 are transported together. In other words, the present invention can improve the image forming apparatus 1 in the efficiency with which it can be transported.

Further, the present invention makes it unnecessary to provide the image forming apparatus 1 with an elastic member for filling the gap between the door 2 and cartridge 11 in order to prevent the cartridge 11 from rattling in the apparatus main assembly 3 while the image forming apparatus 1 is transported with the cartridge 1 mounted in the apparatus main assembly 3. Without the presence of the elastic member, there is no reactive force which would have occurred as the elastic member were pressed (compressed) by the door 2 and the cartridge 11. Thus, the door 2 does not need to be made more rigid than necessary for the door to withstand being opened or closed as a part of the external cover of the apparatus main assembly 3. Therefore, it is possible to simplify the door 2, which in turn makes it possible to reduce in amount the force necessary to operate the door 2.

Further, the cartridge displacement preventing portion 31*a* is positioned at the front end of the cartridge 11 in terms of the cartridge insertion direction. Therefore, more latitude is afforded in terms of the positioning of the cartridge displacement preventing portion 31*a* relative to a plane perpendicular to the cartridge insertion direction (plane perpendicular to axial line of photosensitive drum 12). Therefore, it is possible to place the cartridge displacement preventing portion 31*a* at roughly the center of the cartridge 11, in terms of the direction perpendicular to the cartridge insertion direction. Incidentally, the roughly center portion of the cartridge 11 in terms of the direction perpendicular to the cartridge insertion direction is higher in rigidity than the edge portion of the cartridge 11.

On the other hand, in a case where the cartridge displacement preventing portion 31*a* is placed at the rear end of the cartridge 11 in terms of the cartridge insertion direction, the cartridge displacement preventing portion 31*a* has to be placed near the edge portion of the cartridge 11 in terms of the direction perpendicular to cartridge insertion direction. Placing the cartridge displacement preventing portion 31*a* near the edge of the cartridge 11 is likely to make the cartridge displacement preventing portion 31*a* less rigid than placing the cartridge displacement preventing portion 31*a* at the center of the cartridge 11.

Further, when the tray raising mechanism is moved from the first position to the second position, it moves upward while moving inward of the apparatus main assembly 3. Therefore, while the tray 41 is raised by the tray raising mechanism from the first position to the second position, the tray raising mechanism remains in contact with the bottom surface of the cartridge 11, with the cartridge 11 remaining under the pressure which works in the direction to press the cartridge 11 inward of the apparatus main assembly 3. Therefore, when the cartridge 11 is mounted into the apparatus main assembly 3, it is precisely positioned relative to the apparatus main assembly 3.

Embodiment 2

Next, referring to FIGS. 12 and 13(*a*)-13(*c*), the second preferred embodiment of the present invention will be described in detail.

Figure 12:
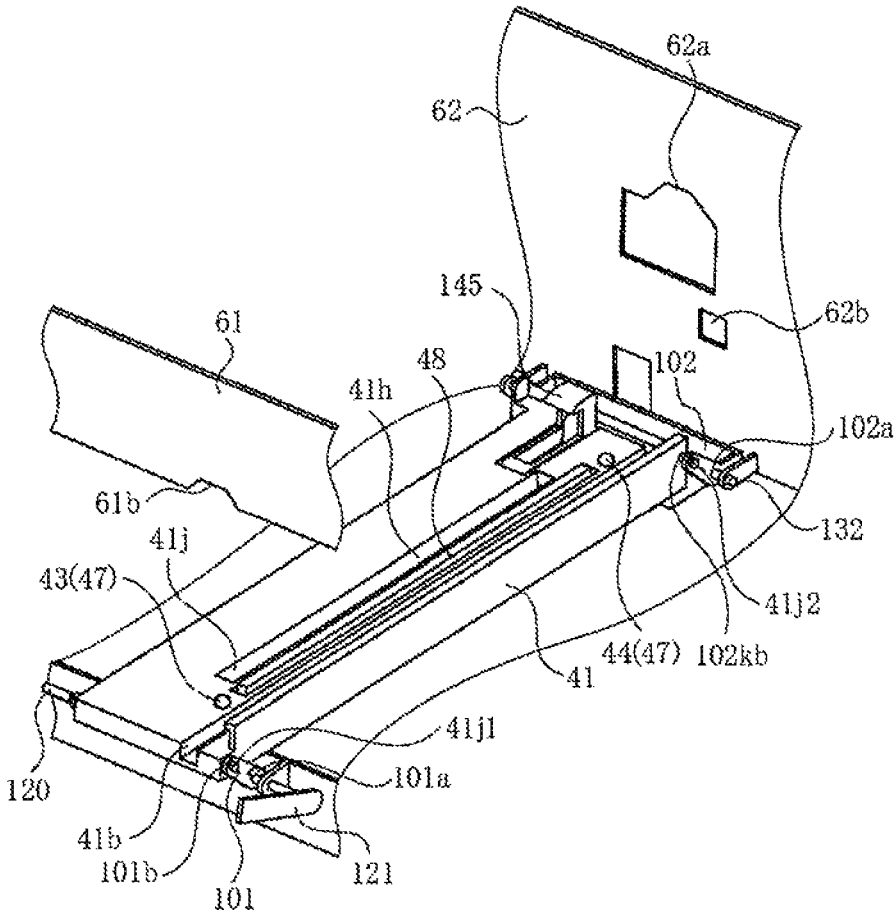
FIG. 12 is a perspective view of the tray raising mechanism in the second preferred embodiment of the present invention.

FIG. 12 is a perspective view of the essential portions of the cartridge regulating portion of the image forming apparatus in the second preferred embodiment of the present invention, and is provided to illustrate the structures of the essential portions, and in which the tray 41 is in its first position (which allows cartridge to be inserted). FIGS. 13(*a*)-13(*c*) are side views of one of the cartridge chambers of the apparatus main assembly 3, and the cartridge 11 which is being mounted into the chamber. They are for illustrating how the cartridge displacement preventing mechanism operates as the cartridge 11 is mounted in the apparatus main assembly 3.

This embodiment is different from the first embodiment only in the structure of the cartridge regulating portion of the image forming apparatus. Referring to FIG. 12, unlike the cartridge regulating portion in the first embodiment described above, the cartridge regulating portion in this embodiment is a part of the edge portion of the opening 62*b* of the rear wall 62 of the apparatus main assembly 3.

Figure 13:
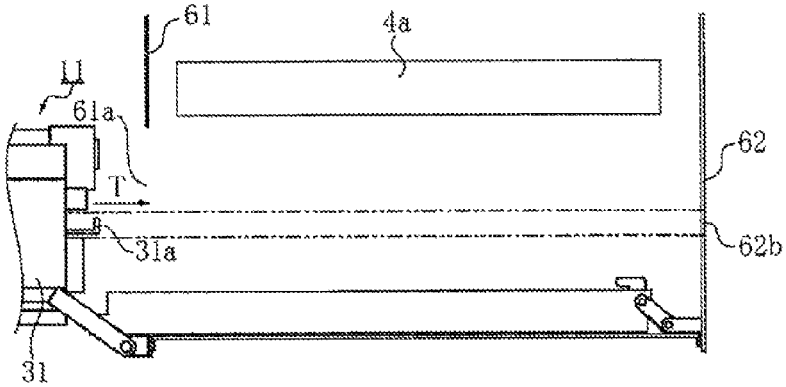
FIGS. 13(*a*)-13(*c*) are three schematic drawings of the mechanism, in the second embodiment, for preventing the cartridge from popping out of the main assembly of the image forming apparatus after being precisely positioned in its second position, which are for illustrating the operation of the mechanism.
Figure 13:
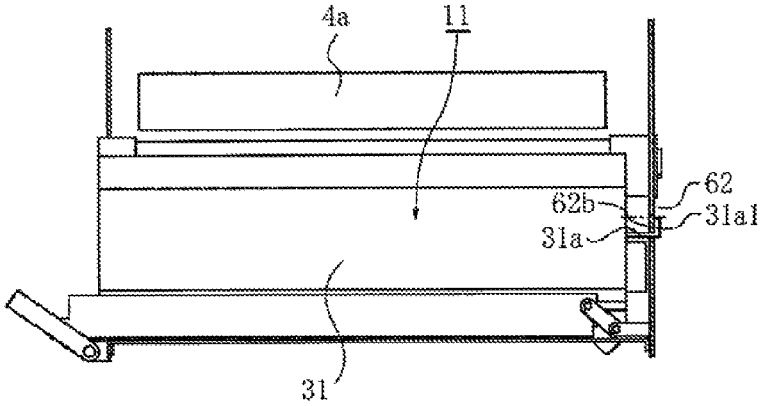
Figure 13:
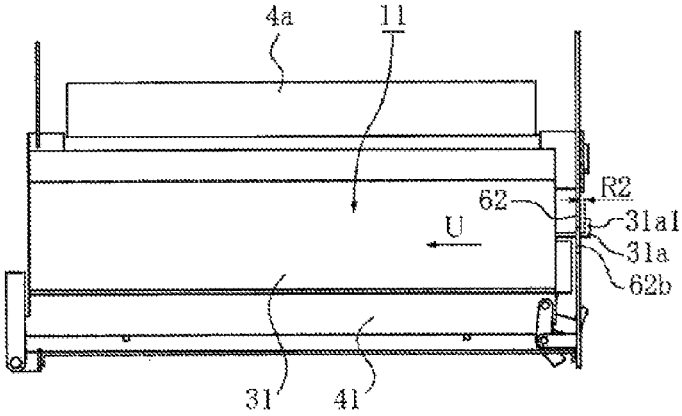

FIG. 13(*a*) illustrates the state of the cartridge regulating mechanism prior to the insertion of the cartridge 11 into the apparatus main assembly 3. Referring to FIG. 13(*a*), the cartridge 11 is inserted into the apparatus main assembly 3 through the opening 61*a* of the front wall 61 of the apparatus main assembly 3 in the direction indicated by an arrow mark T. When the cartridge 11 is in the state shown in FIG. 13(*a*), the cartridge displacement preventing portion 31*a* of the cartridge frame 31 is within the opening 62*b* of the rear wall 62 of the apparatus main assembly 3, as seen from the direction parallel to the cartridge insertion direction. Thus, the cartridge regulating portion 31*a* does not come into contact with the rear wall 62 while the cartridge 11 is advanced to the deepest end of the apparatus main assembly 3 in terms of the cartridge insertion direction.

FIG. 13(*b*) illustrates the state of the cartridge regulating mechanism immediately after the cartridge 11 has just been inserted to the deepest end of the apparatus main assembly 3 in terms of the cartridge insertion direction. When the cartridge regulating mechanism is in this state, the cartridge regulating vertical surface 31*a*1 of the cartridge regulating portion 31*a* of the cartridge 11 is beyond the rear wall 61 of the apparatus main assembly 3 in terms of the cartridge insertion direction. Also when the cartridge regulating mechanism is in this state, the cartridge regulating portion 31*a* of the cartridge frame 31 is within the opening 62*b*, as seen from the direction parallel to the cartridge insertion direction. Therefore, the cartridge regulating portion 31*a* and the rear wall 62 do not come into contact with each other even if the cartridge 11 is removed.

FIG. 13(*c*) illustrates the state of the cartridge regulating mechanism after the completion of the cartridge insertion into the apparatus main assembly 3. After the cartridge 11 is inserted to the deepest end of the apparatus main assembly 3 in terms of the cartridge insertion direction, the tray 41 is raised by the tray raising mechanism while remaining horizontal. Thus, the cartridge 11 is vertically moved upward. While the tray 41 is in its second position, the cartridge regulating portion 31*a* overlaps with the rear wall 62 of the apparatus main assembly 3 as seen from the direction parallel to the cartridge insertion direction. Thus, as long as the tray 41 is in its second position, the cartridge 11 is kept in its second position, and therefore, it does not occur that the cartridge 11 is made to pop out of the apparatus main assembly 3 by the vibrations and/or impacts, which occur during the transportation of the image forming apparatus and the cartridge 11 therein, because, as the cartridge 11 is pushed in the direction indicated by an arrow mark U by the abovementioned vibration and/or impacts, the cartridge regulating vertical surface 31*a*1 of the cartridge regulating portion 31*a* comes into contact with the rear wall 62 of the apparatus main assembly 3, and therefore, the movement of the cartridge 11 in the direction indicated by the arrow mark U is limited to no more than a distance equivalent to the gap R2 between the rear wall 62 and cartridge regulating vertical surface 31*a*1. Further, while the cartridge 11 is in its second position, it can be removed. In other words, this embodiment achieves the same effects as those achievable by the first embodiment. In addition, in this embodiment, the rear wall 62 plays the role of the cartridge displacement preventing portion 49 in the first embodiment, making it unnecessary to provide the apparatus main assembly 3 with the cartridge displacement preventing portion 49, that is, an additional component for regulating the cartridge 11.

In this embodiment, the apparatus main assembly 3 and the cartridge 11 are structured so that while the tray 41 is in its second position, there is the gap R2 between the rear wall 62 of the apparatus main assembly 3, and the cartridge position regulating portion 31*a* of the cartridge 11. However, the apparatus main assembly 3 and the cartridge 11 may be structured so that while the tray 41 is in the second position, the rear frame 62 and cartridge position regulating portion 31*a* remain in contact with each other; that is, there is no gap between them. Further, in this embodiment, the cartridge position regulating portion of the cartridge 11 is in the form of a letter L, whereas the cartridge position regulating portion of the apparatus main assembly 3 is a part of the edge portion of the cartridge insertion opening of the apparatus main assembly 3. However, the apparatus main assembly 3 and the cartridge 11 may be structured so that the cartridge position regulating portion of the cartridge 11 is a part of the edge of a hole with which the frame of the cartridge 11 is provided, and the cartridge position regulating portion of the apparatus main assembly 3 is in the form of a letter L.

Embodiment 3

Figure 14:
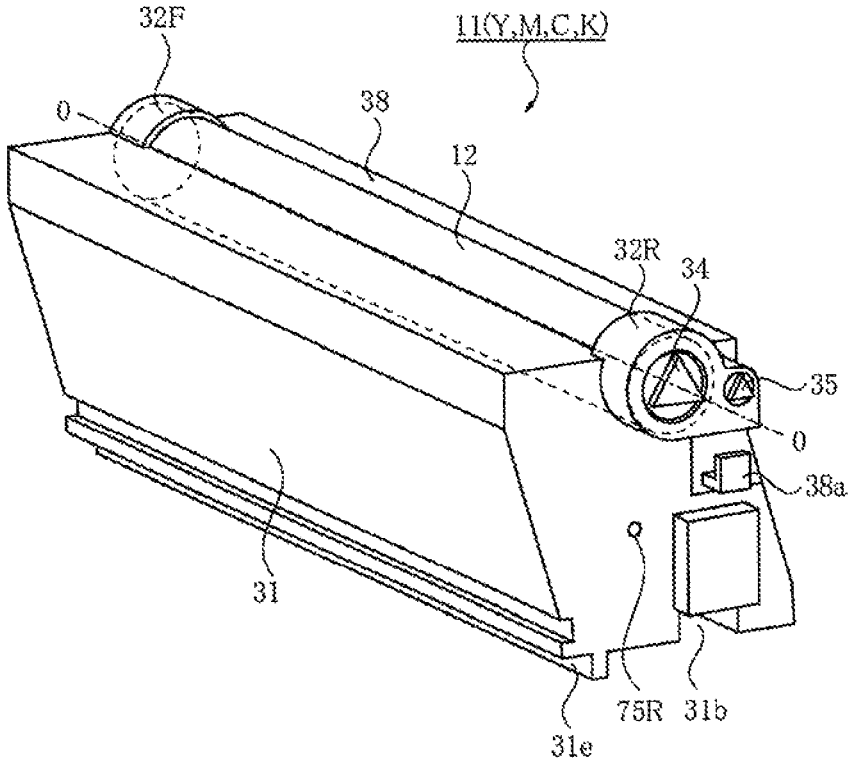
FIG. 14 is an external perspective view of the cartridge in the third preferred embodiment of the present invention, as seen from the front side of the cartridge in terms of the direction in which the cartridge is mounted.
Figure 15:
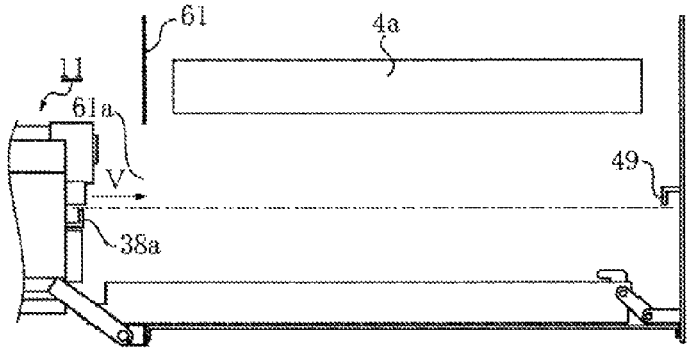
FIGS. 15(*a*)-15(*c*) are three schematic drawings of the mechanism, in the third embodiment, for preventing the cartridge from popping out of the main assembly of the image forming apparatus after being precisely positioned in its second position, which are for illustrating the operation of the mechanism.
Figure 15:
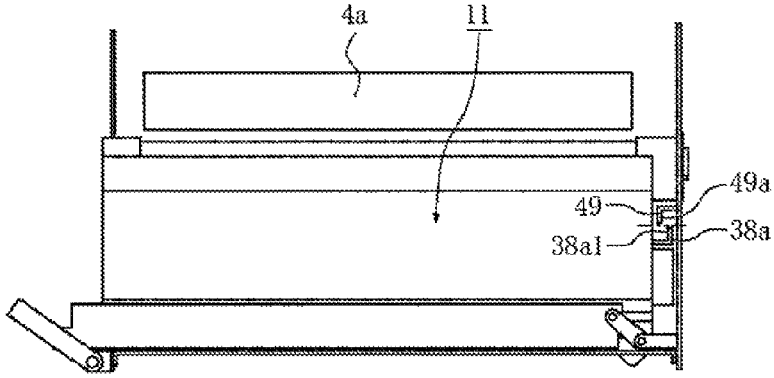
Figure 15:
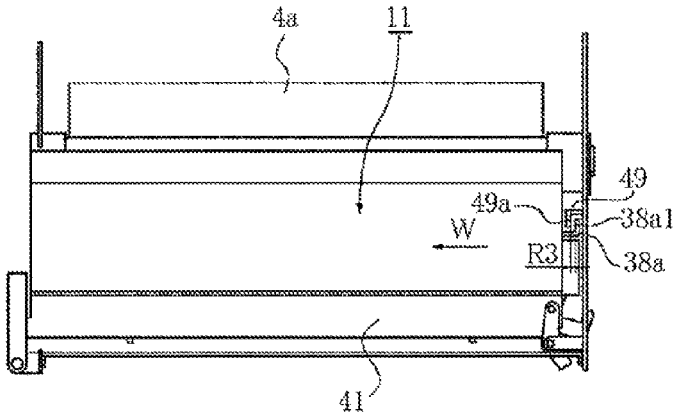

Next, referring to FIGS. 14 and 15(*a*)-15(*c*), the third preferred embodiment of the present invention will be described. FIG. 14 is an external perspective view of the cartridge in the third preferred embodiment of the present invention, and depicts the cartridge regulating structure of the cartridge. FIGS. 15(*a*)-15(*c*) are side views of the cartridge 11, and one of the cartridge chambers of the main assembly 3 of the image forming apparatus in this embodiment, which are for illustrating how the cartridge displacement preventing mechanism operates as the cartridge 11 is mounted in the apparatus main assembly 3.

The third preferred embodiment of the present invention is different from the first one only in the positioning of the cartridge regulating portion of the cartridge 11. Referring to FIG. 14, the cartridge position regulating portions in this embodiment also are made up of the cartridge position regulating portion 38*a* with which the cartridge is provided, and the cartridge position regulating portion 49*a* with which the apparatus main assembly 3 is provided. Also in this embodiment, the cartridge position regulating portions 38*a* and 49*a* are in the form of a letter L. However, unlike the cartridge position regulating portions in the first embodiment, the cartridge position regulating portion 38*a* of the cartridge 11 is a part of the development unit frame 38, which is roughly at the center of the development unit frame 38 in terms of the direction perpendicular to the cartridge insertion direction. The cartridge position regulating portion 38*a* in this embodiment is also rigid because of its positioning described above.

FIG. 15(*a*) illustrates the state of the cartridge position regulating mechanism prior to the insertion of the cartridge 11 into the apparatus main assembly 3. Referring to FIG. 15(*a*), the cartridge 11 is inserted into the apparatus main assembly 3 through the opening 61*a* of the front wall 61 of the apparatus main assembly 3 in the direction indicated by an arrow mark V. When the cartridge 11 is in the state shown in FIG. 15(*a*), the cartridge displacement preventing portion 31*a* of the development unit frame 38 does not overlap with the cartridge position regulating portion 49 of the apparatus main assembly 3, as seen from the direction parallel to the cartridge insertion direction. Thus, the cartridge regulating portion 31*a* does not come into contact with the rear wall 62 while the cartridge 11 is advanced to the deepest end of the apparatus main assembly 3 in terms of the cartridge insertion direction.

FIG. 15(*b*) illustrates the state of the cartridge position regulating mechanism immediately after the cartridge 11 has just been inserted to the deepest end of the apparatus main assembly in terms of the cartridge insertion direction. When the cartridge regulating mechanism is in this state, the cartridge position regulating vertical surface 31*a*1 of the cartridge position regulating portion 31*a* of the cartridge 11 is on the inward side of the cartridge position regulating vertical surface 49*a* of the cartridge position regulating portion 49 of the apparatus main assembly 3 in terms of the cartridge insertion direction. Also, when the cartridge regulating mechanism is in this state, the cartridge regulating portion 31*a* of the cartridge frame 31 does not overlap with the cartridge position regulating portion 49, as seen from the direction parallel to the cartridge insertion direction. Therefore, the cartridge position regulating portions 31*a* and the cartridge position regulating portion 49 do not come into contact with each other even if the cartridge 11 is removed.

FIG. 15(*c*) illustrates the state of the cartridge regulating mechanism immediately after the completion of the cartridge insertion into the apparatus main assembly 3. After the cartridge 11 is inserted to the deepest end of the apparatus main assembly 3 in terms of the cartridge insertion direction, the tray 41 is raised by the tray raising mechanism while remaining horizontal. Thus, the cartridge 11 is vertically moved upward. While the tray 41 is in its second position, the cartridge position regulating portion 31*a* overlaps with the cartridge position regulating portion 49, as seen from the direction parallel to the cartridge insertion direction. Thus, while the tray 41 is in its second position, the cartridge 11 is kept in its second position, and therefore, it does not occur that the cartridge 11 is made to pop out of the apparatus main assembly 3 by the vibrations and/or impacts, which occur during the transportation of the image forming apparatus and the cartridge 11 therein, because, as the cartridge 11 is pushed in the direction indicated by an arrow mark W by the abovementioned vibration and/or impacts, the cartridge regulating vertical surface 31*a*1 of the cartridge regulating portion 31*a* comes into contact with the cartridge position regulating surface 49*a* of the cartridge position regulating portion 49, and therefore, the movement of the cartridge 11 in the direction indicated by the arrow mark W is limited to no more than a distance equivalent to the gap R3 between the cartridge regulating vertical surfaces 31*a*1 and 49*a*. Further, while the cartridge 11 is in its second position, it cannot be removed. In other words, this embodiment can achieve the same effects as those achievable by the first embodiment. In addition, the cartridge position regulating portion 38*a* in this embodiment is formed as a part of the development unit. Thus, the vibrations and/or impacts which occur during the transportation of the image forming apparatus are caught by the development unit, which is heavier than the latent image formation unit. Therefore, it is unnecessary for the development unit supporting portion of the latent image formation unit to be rigid enough to withstand the abovementioned vibrations and/impacts.

In this embodiment, the apparatus main assembly 3 and cartridge 11 are structured so that there is the gap R3 between the cartridge position regulating portion 49 of the apparatus main assembly 3 and the cartridge position regulating portion 38*a* of the cartridge 11 in terms of the direction in which the cartridge 11 is moved out of the apparatus main assembly 3. However, the apparatus main assembly 3 and cartridge 11 may be structured so that while the tray 41 is in the second position, the cartridge position regulating portions 49 and 38*a* remain in contact with each other; that is, there is no gap between them.

In the first to third preferred embodiments of the prevent invention described above, the cartridge was a process cartridge. However, the present invention is applicable to any cartridge which is removably mountable in the main assembly of an apparatus. That is, the present invention is applicable to a developer cartridge (which stores at least developer), a development cartridge (which has at least developer bearing member), or a latent image formation cartridge (which has at least electrophotographic photosensitive member).

As will be evident from the above given description of the first to third embodiments of the present invention, the present invention makes it possible to place a combination of the main assembly of an image forming apparatus and a cartridge (cartridges) in a significantly smaller box than a box which has been conventionally used, when transporting the combination. Thus, the present invention can increase the efficiency with which the combination is transported. Further, the present invention can prevent the problem that in a case where an image forming apparatus is transported with a cartridge(s) for the apparatus mounted in the main assembly of the apparatus, the cartridge(s) becomes displaced relative to the main assembly. Further, the present invention can make significantly smaller the amount of force necessary to mount a cartridge into the main assembly of an image forming apparatus than the amount of force necessary to mount a conventional process cartridge into the main assembly of a conventional image forming apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 135683/2008 filed May 23, 2008 which is hereby incorporated by reference.

What is claimed is:

1. A cartridge detachably mountable to a main assembly of the image forming apparatus, said cartridge comprising:

a portion to be urged by an urging portion of the image forming apparatus so as to be moved in a crossing direction which crosses an inserting direction in which said cartridge is inserted into the image forming apparatus, after said cartridge is inserted into the main assembly of the image forming apparatus through an opening in the main assembly;

a portion to be positioned by contacting a positioning portion of the image forming apparatus by said cartridge being moved by the urging portion in the crossing direction to position said cartridge relative to the main assembly of the apparatus; and a portion to be regulated by a regulating portion of the image forming apparatus so as to prevent said cartridge from moving toward an outside of the image forming apparatus through the opening therein in a state that the portion to be positioned contacts the positioning portion, wherein the regulating portion is provided in downstream side of the opening with respect to the inserting direction, and said portion to be regulated is brought, by movement of said cartridge in the crossing direction by the urging portion, to a regulating position where said portion to be regulated is disposed downstream of the regulating portion with respect to the inserting direction to prevent said cartridge from moving toward the outside of the image forming apparatus through the opening.

2. A cartridge according to claim 1, further comprising a photosensitive member unit including an electrophotographic photosensitive member, and a developing unit including a developer carrying member configured to carry a developer to develop an electrostatic latent image formed on said electrophotographic photosensitive member, and a developer containing portion containing developer, wherein said portion to be regulated is provided on said developing unit.

3. A cartridge according to claim 1, further comprising a photosensitive member unit including an electrophotographic photosensitive member and said portion to be positioned, and a developing unit movable relative to said photosensitive member unit and including a developer carrying member configured to carry a developer to develop an electrostatic latent image formed on said electrophotographic photosensitive member and a developer containing portion containing the developer, wherein said portion to be regulated is provided on said photosensitive member unit.

4. A cartridge according to claim 1, wherein said portion to be regulated is brought to the regulating position without contact with the regulating portion.

5. A cartridge according to claim 1, wherein said cartridge includes a rotatable electrophotographic photosensitive member, and wherein the inserting direction is parallel to a rotational axis of said electrophotographic photosensitive member.

6. A cartridge according to claim 5, further comprising a supporting member configured to rotatably support said electrophotographic photosensitive member at an end of said electrophotographic photosensitive member with respect to the direction of the rotational axis, wherein said supporting member is provided with said portion to be positioned.

7. A cartridge according to claim 1, wherein said portion to be regulated is disposed on a downstream side of said cartridge.

8. An image forming apparatus for forming an image on a recording material, said apparatus comprising:

a main assembly including an opening, an urging portion, a positioning portion and a regulating portion;

a cartridge configured to be dismountably mounted to said main assembly, said cartridge including:

a portion to be urged by said urging portion so as to be moved in a crossing direction which crosses an inserting direction in which said cartridge is inserted into said main assembly through said opening, after said cartridge is inserted into the main assembly of the apparatus through said opening;

a portion to be positioned by contacting said positioning portion by said cartridge being moved by said urging portion in the crossing direction to position said cartridge relative to said main assembly; and a portion to be regulated by said regulating portion so as to prevent said cartridge from moving toward an outside of said main assembly through said opening in a state that said portion to be positioned is in contact with said positioning portion, wherein said regulating portion is provided in a downstream side of the opening with respect to the inserting direction, and said portion to be regulated is brought, by movement of said cartridge in the crossing direction by said urging portion, to a regulating position where said portion to be regulated is disposed downstream of said regulating portion with respect to the inserting direction to prevent said cartridge from moving toward the outside of said main assembly through said opening.

9. An apparatus according to claim 8, wherein said cartridge further includes a photosensitive member unit including an electrophotographic photosensitive member, and a developing unit including a developer carrying member configured to carry a developer to develop an electrostatic latent image formed on said electrophotographic photosensitive member, and a developer containing portion containing developer, wherein said portion to be regulated is provided on said developing unit.

10. An apparatus according to claim 9, wherein said portion to be regulated is disposed on a downstream side of said cartridge.

11. An apparatus according to claim 9, further comprising a plurality of such cartridges containing different color developers.

12. An apparatus according to claim 8, wherein said cartridge further includes a photosensitive member unit including an electrophotographic photosensitive member and said portion to be positioned, and a developing unit movable relative to said photosensitive member unit and including a developer carrying member configured to carry a developer to develop an electrostatic latent image formed on said electrophotographic photosensitive member and a developer containing portion containing the developer, wherein said portion to be regulated is provided on said photosensitive member unit.

13. An apparatus according to claim 8, wherein said portion to be regulated is bought to the regulating position without contacting said regulating portion.

14. An apparatus according to claim 8, wherein said cartridge includes a rotatable electrophotographic photosensitive member, and wherein the inserting direction is parallel to a rotational axis of said electrophotographic photosensitive member.

15. An apparatus according to claim 14, wherein said cartridge further includes a supporting member configured to rotatably support said electrophotographic photosensitive member at an end of said electrophotographic photosensitive member with respect to the direction of the rotational axis, wherein said supporting member is provided with said portion to be positioned.

16. An apparatus according to claim 8, wherein said main assembly further includes a door configured to open and close said opening, wherein said urging portion urges said portion to be urged by said door closing said opening to move said cartridge in the crossing direction.

17. An apparatus according to claim 8, wherein said main assembly further includes an electrophotosensitive photosensitive member and transferring means for transferring a developed image formed on said electrophotographic photosensitive member onto the recording material, and wherein said cartridge contacts said transferring means by said cartridge moving in the crossing direction.

18. An apparatus according to claim 8, wherein said main assembly further includes a cartridge supporting member configured to support said cartridge when said cartridge is inserted into said main assembly, and wherein said cartridge supporting member is provided with said urging portion.

19. An apparatus according to claim 18, wherein said portion to be regulated is moved to said regulating position by said cartridge supporting member moving upwardly.

20. An apparatus according to claim 8, wherein said urging portion is disposed at a position below said cartridge when said cartridge is inserted into said main assembly, and wherein said cartridge is moved upwardly by an upward movement of said urging portion.

21. An apparatus according to claim 8, wherein said positioning portion is provided at an edge defining said opening.

* * * * *